US006564023B2

(12) United States Patent
Takami et al.

(10) Patent No.: US 6,564,023 B2
(45) Date of Patent: May 13, 2003

(54) IMAGE FORMING APPARATUS WITH AC CURRENT DETECTOR

(75) Inventors: Hiroshi Takami, Kanagawa-ken (JP); Tomohiro Nakamori, Shizuoka-ken (JP); Masaru Shimura, Shizuoka-ken (JP); Seiji Saito, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,620

(22) Filed: Apr. 27, 2001

(65) Prior Publication Data

US 2002/0006289 A1 Jan. 17, 2002

(30) Foreign Application Priority Data

Apr. 28, 2000 (JP) ..... 2000-130880
Jul. 4, 2000 (JP) ..... 2000-202074

(51) Int. Cl.[7] ..... G03G 15/02
(52) U.S. Cl. ..... 399/50; 361/235; 399/176
(58) Field of Search ..... 355/50, 168, 174, 355/176; 361/235

(56) References Cited

U.S. PATENT DOCUMENTS 4,346,986 A * 8/1982 Kuge et al. ..... 399/50
5,420,671 A * 5/1995 Kisu et al. ..... 399/174
5,568,231 A * 10/1996 Asano et al. ..... 399/50 X

FOREIGN PATENT DOCUMENTS

JP 59-101668 * 6/1984
JP 8-149808 * 6/1996
JP 10-3199 * 1/1998

OTHER PUBLICATIONS

U.S. patent application No. 09/312,846, filed May 17, 2001 (Group Art Unit 2878).

* cited by examiner

*Primary Examiner*—Fred L Braun
(74) *Attorney, Agent, or Firm*—Fitzpatrick, Cella, Harper & Scinto

(57) ABSTRACT

An image forming apparatus includes an image bearing member and a charge member for electrically charging the image bearing member while contacting the image bearing member. An oscillating voltage, including a component of AC voltage, is applied to the charge member. A first detector detects an average of the AC current applied to the charge member. A second detector detects a value of the AC current corresponding to a peak of the AC voltage. A controller effects control such that when a detected current value is smaller than a first predetermined value, the detected current value of the first detector is at the first predetermined value, and when the detected current value of the first detector is larger than the first predetermined value, a current value of the second detector is at a second predetermined value.

15 Claims, 30 Drawing Sheets

IMAGE FORMING APPARATUS WITH AC CURRENT DETECTOR

FIELD OF THE INVENTION AND RELATED ART

The present invention relates to an image forming apparatus such as a copying machine, printer, facsimile machine or the like of an electrophotographic type, more particularly to an apparatus wherein a charge member contacted to the image bearing member to electrically charge the image bearing member.

The image formation process in an electrophotographic apparatus includes a uniform charging step of electrically charging an electrophotographic photosensitive member (photosensitive drum) to a predetermined uniform potential, as is well known. With an example of charging means for this purpose, a charge member in the form of a roller (charging roller) is contacted to the surface of the photosensitive drum, and the charging roller is supplied with a charging bias (a voltage in the form of superimposing DC high voltage and sine wave AC high voltage) It is empirically known that discharge current is preferably not lower than a predetermined level in order to provide a stabilized charging.

When the output voltage (sine wave AC voltage (Vo)) as shown in FIG. 19, for example, is applied to the charging roller from the high voltage source, a current having the same phase as the AC voltage (Vo), that is, a resistance load current through a resistance load between the charging roller and the photosensitive drum, a current having the phase which is advanced by 90° beyond the AC voltage (Vo), that is a capacity load current through a capacity load between the charging roller and the photosensitive drum, a pulse current flowing at the peak of the amplitude of the AC voltage (Vo), that is, a discharge current between the charging roller and the photosensitive drum. In total, the waveform of the outputing current is as indicated by Io. Designated by Im is a detected current waveform of the AC current attracted to the high voltage source from the charging roller.

FIG. 20 shows a relation between the amplitude of the AC voltage (the output voltage) and the outputing current (Io). When the amplitude of the AC voltage is gradually increased, the amplitude of the AC voltage and the outputing current are substantially proportional to each other as long as the voltage amplitude is lower than a predetermined level. As shown in FIG. 19, this is because a resistance load current (Izr) and a capacity load current (Izc) are proportional to the voltage amplitude, and discharge phenomenon does not occur because the voltage amplitude is small, which means that no discharge current (Is) flows. When the amplitude of the AC voltage (output voltage) is further increased, the discharge phenomenon occurs at the predetermined voltage amplitude (Vs), and the total outputing current (Io) does not satisfy the proportional relationship, and the discharge current (Is) alone increases.

Therefore, in the prior art, the peak value (Ip in FIG. 19) of the total outputing current is controlled at a predetermined level by a control system which will be described hereinafter, by which the discharge current (Is) is intended to be substantially constant.

FIG. 21 shows a charging bias control circuit for applying the charging bias voltage to the charging roller. As shown in this Figure, the charging roller 2 contacted to the photosensitive drum 1 is connected with a high voltage source 3 and a control device 4 for controlling the high voltage source 3. When the high voltage source 3 receives a clock pulse of a CPU5 of the control device 4, a transistor 8 switches through a pull-up resistor 6 and a base resistor 7 to produce a clock pulse having an amplitude corresponding to an output of an operational amplifier 11 connected with a pull-up resistor 9 through a diode 10.

When the amplitude of the clock pulse is large, the driving voltage amplitude of the sine wave inputted to the high voltage transformer 12 is also large, and as a result, the amplitude of the AC voltage outputted to the charging roller 2 is also large, the clock pulse is inputted to the filter circuit 32, which in turn produces a sine wave output having the central value of +12V. The output is inputted to a primary coil of the high voltage transformer 12 through a high voltage transformer drive, and a sine wave AC high voltage is produced at the secondary coil. One side of the secondary coil is connected with a DC high voltage generating circuit 46 through a resistor 45, and a charging bias voltage in the form of a superimposed DC high voltage and AC high voltage is supplied to the charging roller 2 through an output protection resistor 47.

The filter circuit 32 is constituted by fourth butterworth filter including resistors 13, 14, 15, 16, 17, 18, 19, 20, 21, 22, 23, capacitors 24, 25, 26, 27, 28, 29 and operational amplifiers 30, 31 and a primary high path filter. The high voltage transformer drive circuit 44 is constituted by resistors 33, 34, 35, 36, 37, 38, a capacitor 39, transistors 40, 41, 42 and a Zenorun-diode 43.

The current flowing into the high voltage source 3 from the charging roller 2 is detected by a high voltage capacitor 49 for separating the DC current of the peak current detection circuit 48 from the high voltage source 3 and a current monitoring resistor 50. More particularly, the peak voltage of the detected voltage is held by the diode 51 and the capacitor 52 so that peak current is detected.

The resistor 53 is a discharge resistor for the capacitor 52, and the diode 54 is for current discharge protection.

In order to control the current attracted from the charging roller 2 at a predetermined level, the output of the peak current detection circuit 48 is inputted to a "−" (negative) terminal or contact of the operational amplifier 11, and a reference voltage provided by the resisters 55 and 56 is inputted to a "+" (positive) terminal or contact, and the output terminal or contact of the operational amplifier 11 is connected to an emitter of the transistor 8 through the diode 10, so that amplitude of the clock pulse inputted to the circuit 32 is controlled.

In the above-described conventional example of the charging bias control, as shown in FIG. 22, a discharge start current I1 in an initial property e (initial stage of use) is not kept constant but reduces to a discharge start current I2 as shown in property f after use in the certain term, because of contamination of the charging roller 2 with toner or the like. The discharge current of the peak value Ip increases from Is0 to Is1.

Therefore, if the peak current is controlled to be constant, the discharge current g increases from Is0 to Is1 with the increase of the integrated number of output prints (number of the image formations, as shown In FIG. 23. With further increase of the number of output prints, it exceeds Is1.

On the other hand, as shown in FIG. 23, an amount of scrape of a photosensitive layer at the surface of the photosensitive drum 1 (deterioration of the photosensitive drum 1) increases proportionally to the discharge current, and as a result, the speed of the scrape acceleratedly increases. This has shortened the service life of the photosensitive drum 1.

SUMMARY OF THE INVENTION

Accordingly, it is a principal object of the present invention to provide an image forming apparatus in which deterioration of an image bearing member attributable to a discharge current is prevented while avoiding improper charging. According to an aspect of the present invention, there is provided an image forming apparatus comprising an image bearing member;

a charge member for electrically charging said image bearing member while contacting to said image bearing member; voltage applying means for applying an oscillating voltage including a component of AC voltage to said charge member; first detecting means for detecting an average of the AC current applied to said charge member from said voltage applying means; second detecting means for detection a value of the AC current corresponding to a peak of the AC voltage; and control means for effecting control such that when a detected current value of said detecting means is smaller than a first predetermined value, the detected current value of said first detecting means is at the first predetermined value, and when the detected current value of said first detecting means is larger than the first predetermined value, a current value of said second detecting means is at a second predetermined value.

According to another aspect of the present invention, there is provided an image forming apparatus comprising an image bearing member; a charge member for electrically charging said image bearing member while contacting to said image bearing member; voltage applying means for applying an oscillating voltage including a component of AC voltage to said charge member; detecting means for detecting an average of an AC current supplied to charge member from said voltage applying means in a voltage range wherein an absolute value of the AC voltage is not less than a predetermined value; and control means for effecting control such that average detected current value of said detecting means is at a predetermined value.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the preferred embodiments of the present invention.

Embodiment 1

Figure 1:
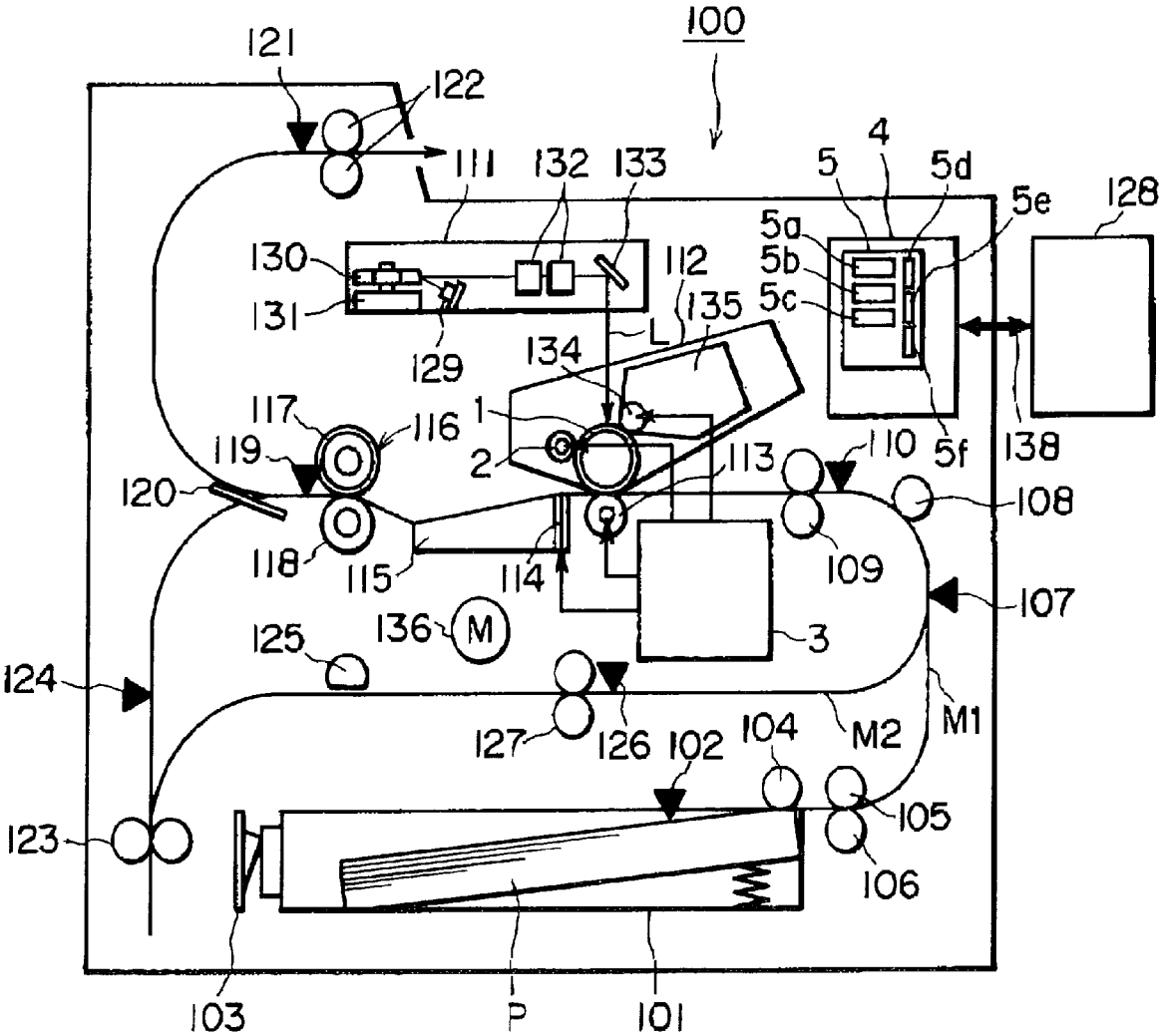
FIG. 1 is a schematic illustration of an image forming apparatus according to an embodiment of the present invention.

FIG. 1 is a schematic illustration of an image forming apparatus according to Embodiment 1. The image forming apparatus of this embodiment is a laser beam printer of an electrophotographic type.

The image forming apparatus 100 comprises an image bearing member in the form of a photosensitive drum 1. Around the photosensitive drum 1 is provided a charging roller 2, a developing device 135, a transfer roller 113 and an exposure device 111 between the photosensitive drum 1 and the developing device 135 in the upper part of the apparatus. A discharging needle 114, a feeding guide 115 and a fixing device 116 are provided downstream of a transfer nip formed between the photosensitive drum 1 and the transfer roller 113 with respect to a feeding direction of the transfer material The photosensitive drum 1, the charging roller 2 and the developing device 135 are contained and unified in a process cartridge 112, which is detachably mountable as a unit to the image forming apparatus 100.

The photosensitive drum 1 in this embodiment is an organic photosensitive member of negative charging property, and is provided with a photosensitive layer on a drum base member of aluminum. It is rotated in the clockwise direction at a predetermined peripheral speed by a main motor 136, and during the rotation, it is uniformly charged to a negative polarity by a charging roller 2 contacted thereto.

The charging roller 2 is a contact-type charging means and is rotatably contacted to the surface of photosensitive drum 1. It is supplied with a charging bias (a AC voltage bias with a DC voltage) supply from a high voltage source 3 and functions to uniformly charge the photosensitive drum 1 to predetermined polarity and potential. The detailed structure of the high voltage source 3 and the AC voltage component in the charging bias applied to the charging roller 2 therefrom will be described in detail hereinafter.

The exposure device 111 comprises a laser unit 129, a polygonal mirror 130, a group of imaging lenses 132 and a folding mirror 133. A laser unit 129 produces a laser beam modulated in accordance with time series electrical digital image signal inputted from an external device 128 such as a personal computer. The laser beam is scanningly deflected by a polygonal mirror 130 which is rotated at a high-speed by a scanner motor 131. The surface of the photosensitive drum 1 is exposed to the image exposure L through the group of the imaging lenses 132 and the fold-back mirror 133. By doing so, an electrostatic latent image is formed correspondingly to the image information.

A developing device 135 comprises a rotatable developing sleeve 134 substantially contacted to the surface of the photosensitive drum 1 at the developing zone. The developing sleeve 134 is supplied with a developing bias from the high voltage source 3 so that toner is deposited onto the electrostatic latent image on the photosensitive drum 1 in the developing zone to form a visualized toner image.

A transfer roller 113 (transferring means) is contacted to the surface of the photosensitive drum 1 with a predetermined pressure to form a transfer nip. The toner image is transferred from the surface of the photosensitive drum 1 onto a transfer material P such as paper at the transfer nip between the photosensitive drum one and the transfer roller 113 by a transfer bias voltage applied from the high voltage source 3.

The fixing device 116 comprises a rotatable fixing roller 117 and a pressing roller 118 to form a nip therebetween. The toner image on the surface of the transfer material P is heated and pressed by the fixing nip and is heat-fixed thereon.

The image forming apparatus 100 as a whole including the high voltage source 3 is controlled by the control device 4. The control device 4 comprises a CPU5 which includes a RAM 5*a*, a RON 5*b*, a timer 5*c*, a digital entering output port 5*d*, an analog-digital conversion input port (AD port) 5*e*, a digital-analog output port (DA port) 5*f*, and comprises a various I/O control circuits (unshown). The control device 4 is connected with an external device 128 such as a personal computer or the like through an interface 138.

The description will be made as to an image forming operation of the image forming apparatus.

During the image formation, and the photosensitive drum 1 is rotated in the clockwise direction at a predetermined peripheral speed by a main motor 136, and is uniformly charged electrically by the charging roller 2 supplied with a charging bias from the high voltage source 3. The photosensitive drum 1 thus charged is supposed to image exposure L by the exposure device 111 so that electrostatic latent image is formed in accordance with image information supplied from the external device 128.

The electrostatic latent image thus formed on the photosensitive drum 1 is developed into a toner image through a reverse development, in which toner charged to the same polarity as the charge polarity (negative polarity) of the photosensitive drum 1 is deposited to the photosensitive drum 1 from a developing sleeve 134 of the developing device 135 supplied with a developing bias of the same polarity as the charge polarity (negative polarity) of the photosensitive drum 1 from the high voltage source 3. In timed relation with the toner image on the photosensitive drum 1 reaches the transfer nip formed between the photosensitive drum 1 and the transfer roller 113, the transfer material P(paper or the like) is supplied to the transfer nip from the cassette 101 by the pick-up roller 104, a retarding roller 106, a sheet feeding roller 108 and a pair of registration rollers 109.

The cassette 101 is provided with a sensor 102 for detecting presence or absence of the transfer material P and a size sensor 103 for detecting a size of the transfer material P. A transfer material feeding path M1 is provided with a sheet feeding sensor 107 for detecting a state of sheet feeding from a duplex print reversion path M2 and a pre-registration sensor 110 for detecting a state of feeding of the transfer material P.

Then, the toner image is transferred from the photosensitive drum 1 by the electrostatic force produced between the photosensitive drum 1 and the transfer roller 113 onto the transfer material P fed into the transfer nip by the transfer roller 113 supplied with the transfer bias of the opposite polarity (positive polarity) as the toner from the high voltage source 3. The transfer material P having a transferred toner image is electrically discharge by discharging needles 114 supplied with a bias voltage from the high voltage source 3, and thereafter, is conveyed by a feeding guide 115 to the fixing device 116, where the toner image is heat-fixed on the transfer material P by the fixing nip formed between the fixing roller 117 and the pressing roller 118. The transfer material P on which the toner image is fixed, is discharged to the outside by a pair sheet discharging rollers 122.

The untransferred toner (residual toner) remaining on the photosensitive drum 1 after the image transfer operation, reaches the developing zone with the rotation of the photosensitive drum 1. The residual toner is collected by a fog removal bias voltage (a fog removal potential difference between the surface potential of the photosensitive drum 1 and the developing bias applied to the developing sleeve 134) in the subsequent developing operation or operations (simultaneous developing and cleaning process).

Downstream of the fixing device 116 with respect to the feeding direction of the transfer material P, there is provided a fixing sheet discharge sensor 119 for detecting a state of feeding of the transfer material F from the fixing device 116. Upstream of the pair of sheet discharging rollers 122 with respect to the feeding direction of the transfer material P, there is provided a sheet discharge sensor 121 for detecting a state of sheet discharge of the transfer material P.

When the image is a formed on both sides of the transfer material P (duplex print), the transfer material P on one side of which an image is formed is fed by switching of a duplex print flapper 120 to a pair of reversion rollers 123 which are rotating in the forward directions. Then, the rotations of the reversion rollers 123 are reversed to feed the transfer material from a duplex print feeding path M2 to a transfer material feeding path M1 with the aid of D cut roller 125 and a pair of duplex feeding rollers 127, and the image formation is carried out on the other surface of the transfer material P in the similar manner. The D cutting roller 125 functions to feed the transfer material P from a lateral registration portion (unshown) for positioning the transfer material P in the lateral direction.

Between the duplex print flapper 120 and the reversion roller 123, there is provided a reversion sensor 124 for detecting a state of feeding of the transfer material P toward the reversion roller 123. Downstream of the duplex feeding rollers 127 with respect to the feeding direction of the transfer material, there is provided a duplex print sensor 126 for detecting a state of feeding of the transfer material P in the duplex print feeding path M2.

The description will be made as to the structure of the high voltage source 3 and the control of an AC voltage applied to the charging roller 2 from the high voltage source 3.

Figure 2:
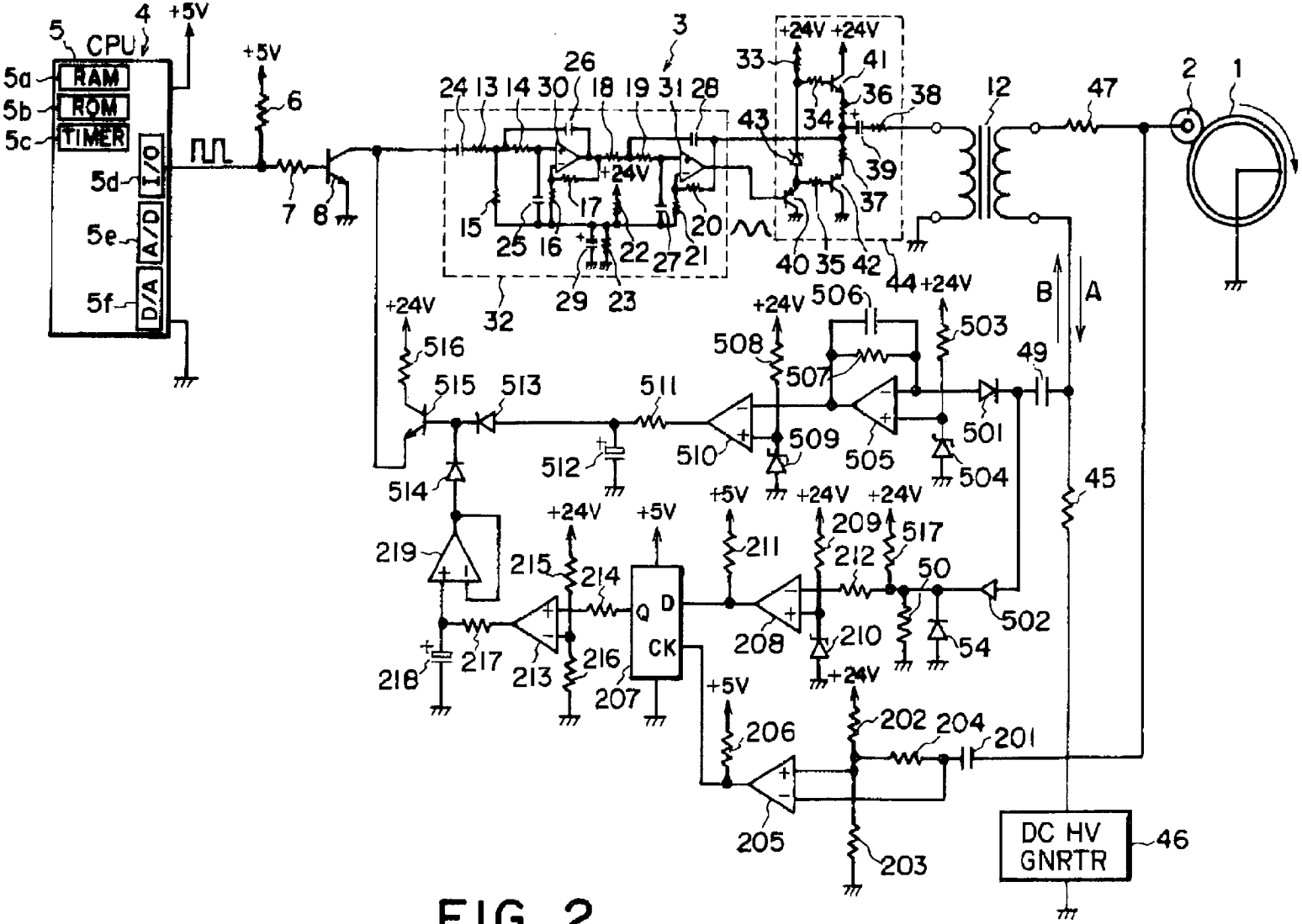
FIG. 2 shows a circuit of a high voltage source according to Embodiment 1.
Figure 21:
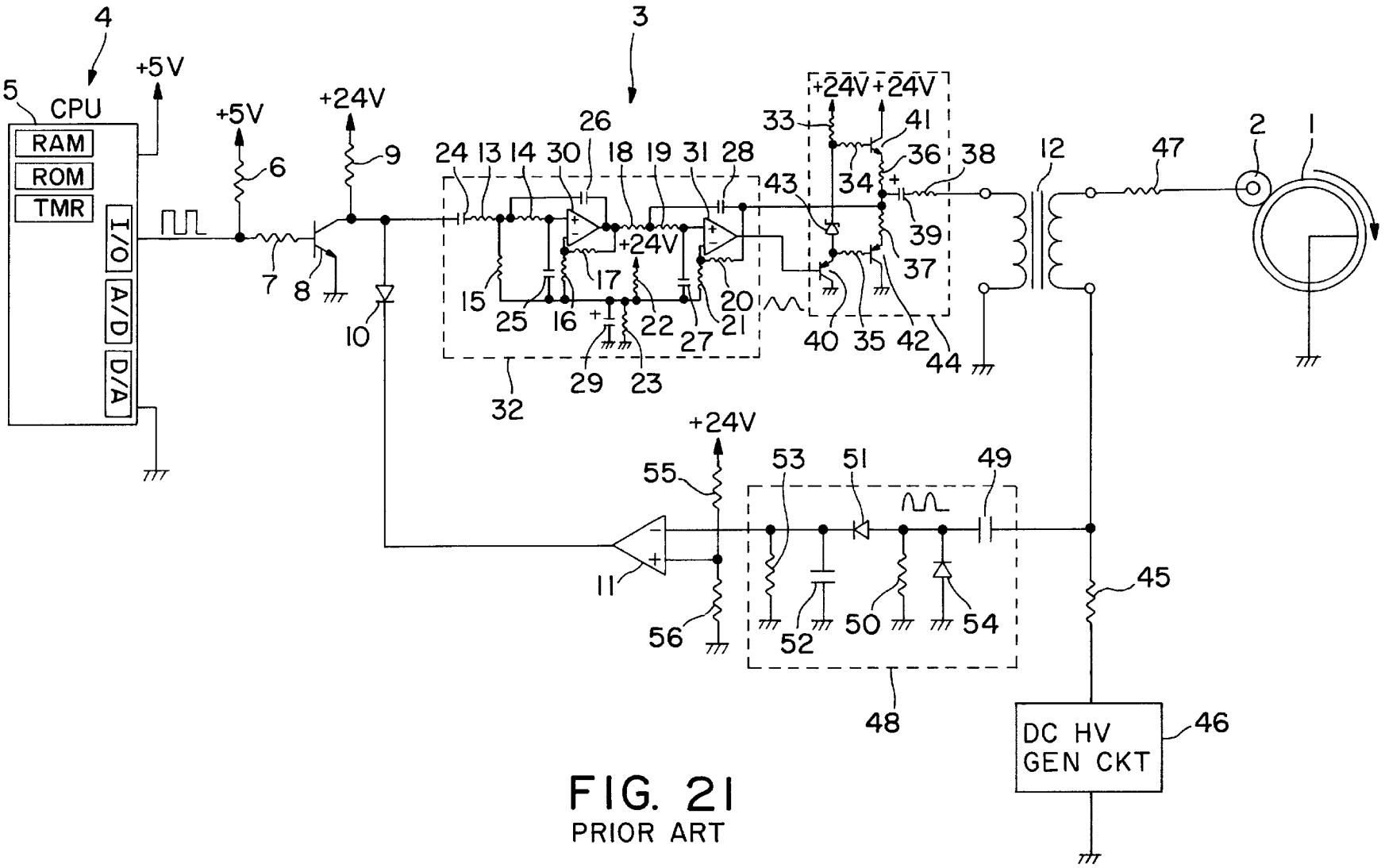
FIG. 21 PRIOR ART
FIG. 21 shows a conventional circuit of a high voltage source.
Figure 22:
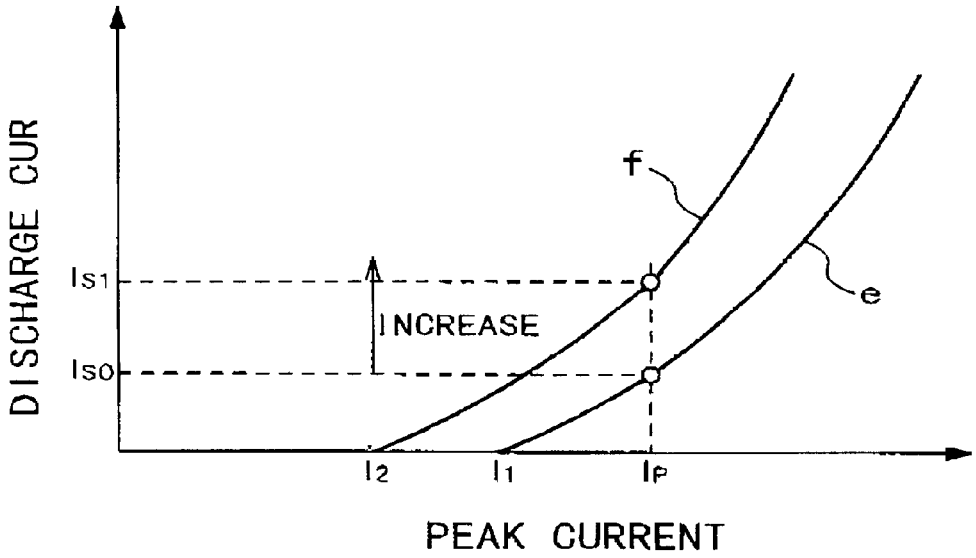
FIG. 22 shows a relation between a peak current and a discharge current in a conventional example.

FIG. 2 is a circuit diagram of the high voltage source 3 employed in this embodiment. The clock generating circuit (resisters 6, 7 and transistor 8), the filter, the high voltage transformer drive circuit 44, the high voltage transformer 12, DC high voltage generating circuit 46 and so on of the high voltage source 3 are the same as that shown in FIG. 21, and therefore, the detailed description thereof is omitted for simplicity.

Referring to FIG. 2, designated by 201 is a high voltage capacitor for providing a differential waveform current of the AC high voltage having a sine wave supplied to the charging roller 2 from the high voltage transformer 12 and is connected to the reference voltage provided as a divided voltage by the resistor 203 and the resistor 204, through a current/voltage conversion resistor 202, and the reference voltage side of the resistor 204 and the detection side thereof are connected to the "+" contact of the comparator 205 of an open collector type and to the – contact thereof, respectively. In order to obtain an accurate differential waveform of the AC high voltage, the resistor value of the resistor 204 is sufficiently smaller than the impedance of the high voltage capacitor 201. A pull-up resistor 206 is connected to an output contact of the comparator 205 at the same side as the power source voltage for a D flip-flop 207.

In this manner, in this embodiment, a phase detecting circuit (phase detecting means) is constituted by the high voltage capacitor 201, the resistors 202, 203, 204.

Figure 3:
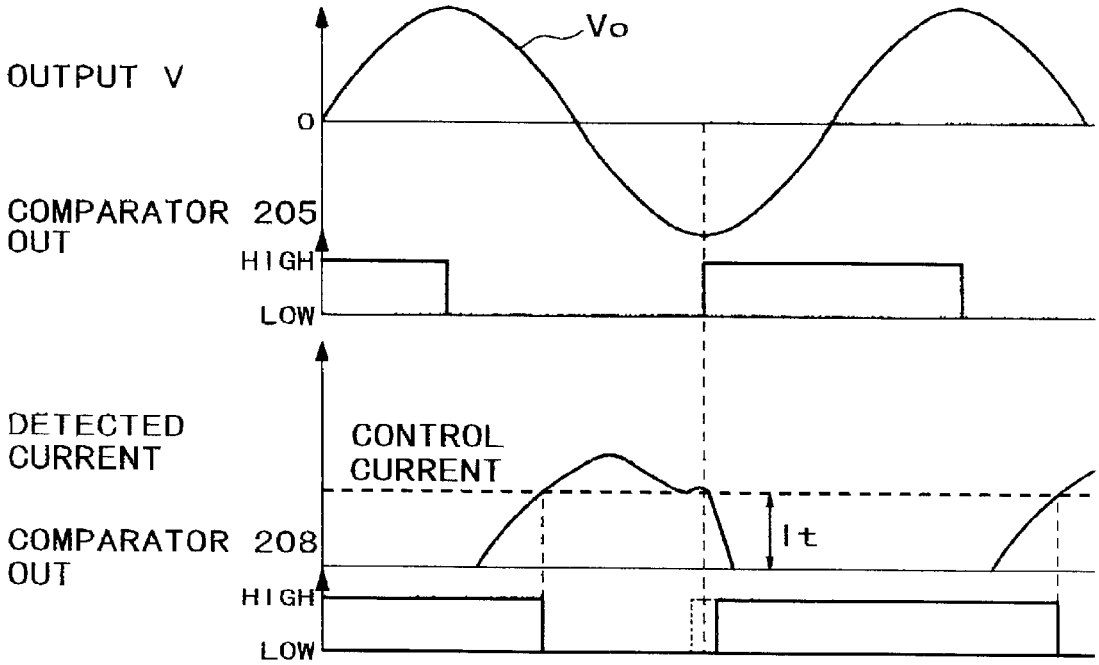
FIG. 3 is a timing chart of a comparator output relative to an output voltage.

Because of the structure of such a circuit, as shown in FIG. 3, the output of the comparator 205 changes from Low to High when the AC high voltage output V0 of sine wave is at the negative peak voltage, and it changes from High to Low and the positive peak voltage. The output of the comparator 205 is supplied to a clock contact (CK contact) of the D flip-flop 207 so that state of the input contact (D contact) can be latched when the output voltage V0 of the AC high voltage is minimum.

The description will be made as to the current through the charging roller 2. The AC current of the sine wave through the charging roller 2 is separated by a diode 501 and a diode 502 into a halt wave current in the direction A toward the high voltage source 3 and a half wave current in the direction B away from the high voltage source 3, and the current detection is carried out by different detection circuits, which will be described hereinafter.

A detection method for the current in the direction indicated by the arrow A will be described first. The AC current in the direction of arrow A is converted to a voltage by the resistor 50 and the resistor 517 through the diode 502, and the converted voltage is supplied to a "–" contact of the comparator 208 of the open collector type through the input resistor 212. The reference voltage provided by the resistor 209 and the Zenorun-diode 210 is inputted to the "+" contact of the comparator 208 such that instantaneous current (peak current) which is detected by the resistor 50 when the high AC output voltage is minimum takes a predetermined value, and the output contact of the comparator 208 is connected to a D contact of the D flip-flop 207 through the pull-up resistor 211.

In this manner, in this embodiment, an instantaneous current detecting circuit (instantaneous current detecting means) is constituted by the diodes 54, 502 and the resistors 50, 517.

With this circuit structure, as shown in FIG. 3, the output of the comparator 205 is Low when the instantaneous current (peak current) at the time when the output voltage V0 of the AC high voltage is at the minimum is higher than a predetermined level (control current) It, and the output Q of the D flip-flop 207 is latched at Low until the output voltage V0 of the AC high voltage next becomes minimum. When the instantaneous current (peak current) at the time when the output voltage V0 of the AC high voltage is at the minimum is lower than the predetermined level (control current) It, it becomes High, and the output Q of the D flip-flop 207 is latched at High.

In order to effect the voltage conversion of the output Q of the D flip-flop 207, it is inputted to the "+" contact of the operational amplifier 213 through the resistor 214, and the voltage provided by dividing the power source voltage (+5V) by the resistors 215, 216 so as to be intermediate of the output voltage amplitude of the D flip-flop 207 is supplied to the – contact. The output of the operational amplifier 213 is integrated by the resistor 217 and a capacitor 218, and the voltage across the capacitor 218 is supplied to an anode of the diode 514 through a voltage follower circuit using the operational amplifier 219.

On the other hand, the half wave current in the direction of arrow B is inputted to an integration circuit comprising an operational amplifier 505, a resistor 507 and a capacitor 506, through a diode 501, is converted to a DC voltage. The voltage at the output contact of the operational amplifier 505 takes a value of the reference voltage provided by the resistor 503 and the Zenorun-diode 504 which is lowered in accordance with the average of the half wave current. The output of the operational amplifier 505 is compared with the reference voltage provided by a resistor 508 and a Zenorun-diode 509 connected to the "+" contact of an operational amplifier 510, and the output of the operational amplifier 510 is integrated by a resistor 511 and a capacitor 512, and thereafter is supplied to a diode 513. In this matter, in this embodiment, an average current detecting circuit (average current detecting means) is constituted by the diode 501, the operational amplifier 505, the resistor 507 and the capacitor 506.

The anode voltage of the diode 513 is stably at 0V when the average current is not lower than a predetermined average current, and rises when it is lower than the predetermined average current. The cathode of the diode 513 and a cathode of the diode 514 are connected with each other, and therefore, either one of the diode 513 and a diode 514 is in an on-state to actuate the transistor 515.

By the above-described control, when the average current is not lower than the predetermined level, the instantaneous current (peak current) in the phase in which the output voltage V0 is minimum is controlled at a predetermined level, and when the average current is lower than the predetermined level, the average current is maintained at the predetermined level. When the instantaneous current (peak current) in the phase in which the output voltage V0 takes a positive peak voltage is controlled to the constant, the input contacts of the comparator 205 are exchanged such that current discharged from the high voltage source portion 3 is detected, by connecting the grounding side of the detected resistor 50 to the predetermined reference voltage side and by exchanging the input contacts of the comparator 208.

Figure 4:
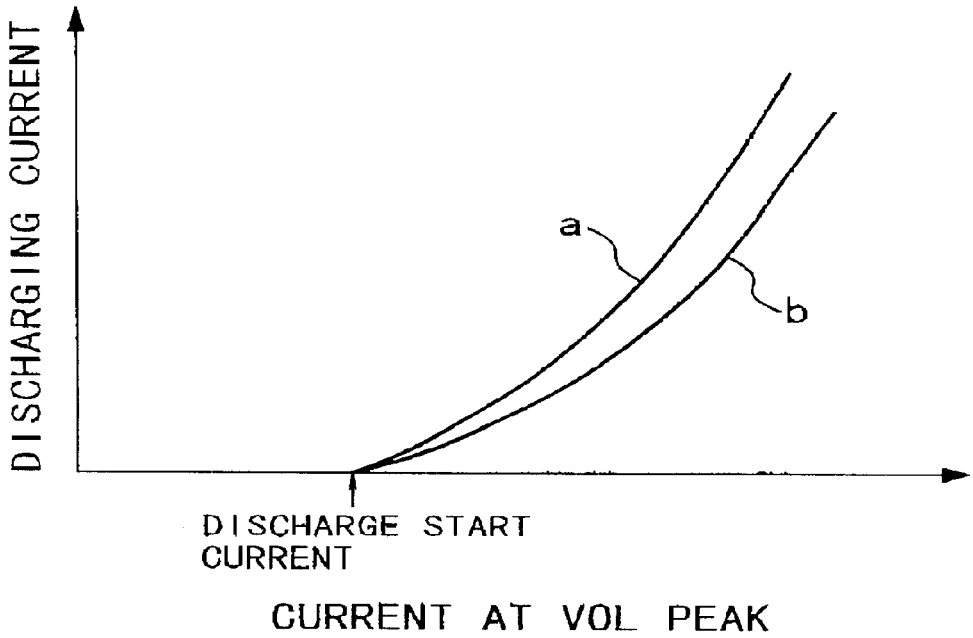
FIG. 4 shows a relation between a current at the peak of a voltage and the discharge current.
Figure 5:
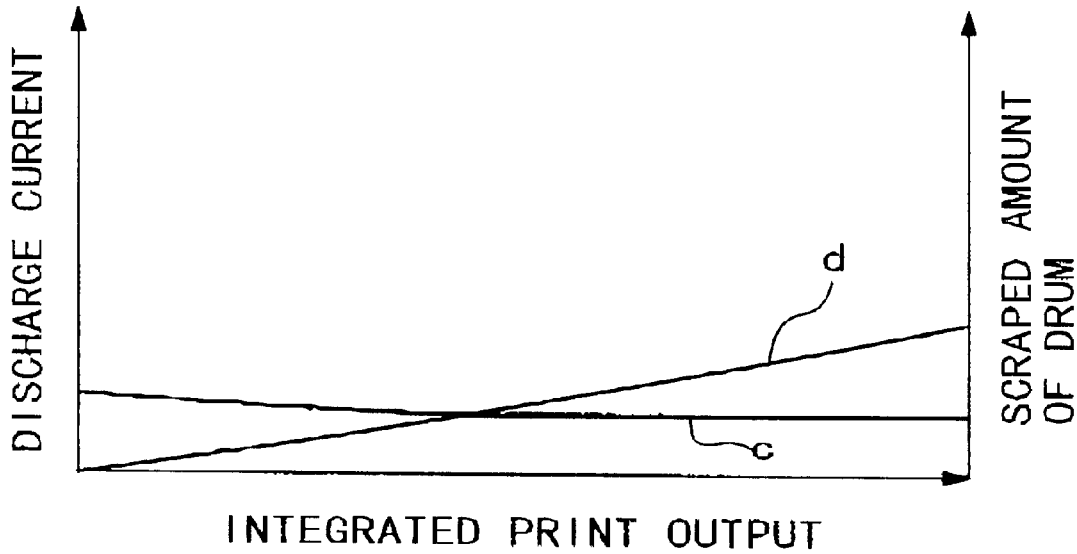
FIG. 5 shows a relation between an integrated number of output prints and a discharge current.

As described in the foregoing, according to the control described in this embodiment, as shown in FIG. 4, the characteristics of the discharge current vs. the instantaneous current at the time of the positive or negative peak voltage of the AC voltage at the initial stage of the use of the charging roller 2 and the characteristics b of the discharge current vs. the instantaneous current at the time of the positive or negative peak voltage of the AC voltage after a predetermined period use thereof, are substantially the same; or the inclination of the characteristics b is slightly smaller. Therefore, as shown in FIG. 5, the increase in the discharge current c attributable to the contamination of the charging roller 2 even if the integrated number of output prints (integrated number of image forming operations), the scraping d of the photosensitive drum 1 can be suppressed, so that service life of the photosensitive drum 1 can be remarkably extended.

Additionally, even when the discharge current lowers after a predetermined period of use, the discharge current is not lower than the predetermined level, and therefore, the image defect attributable to the shortage of the discharge current can be prevented.

Embodiment 2

Figure 6:
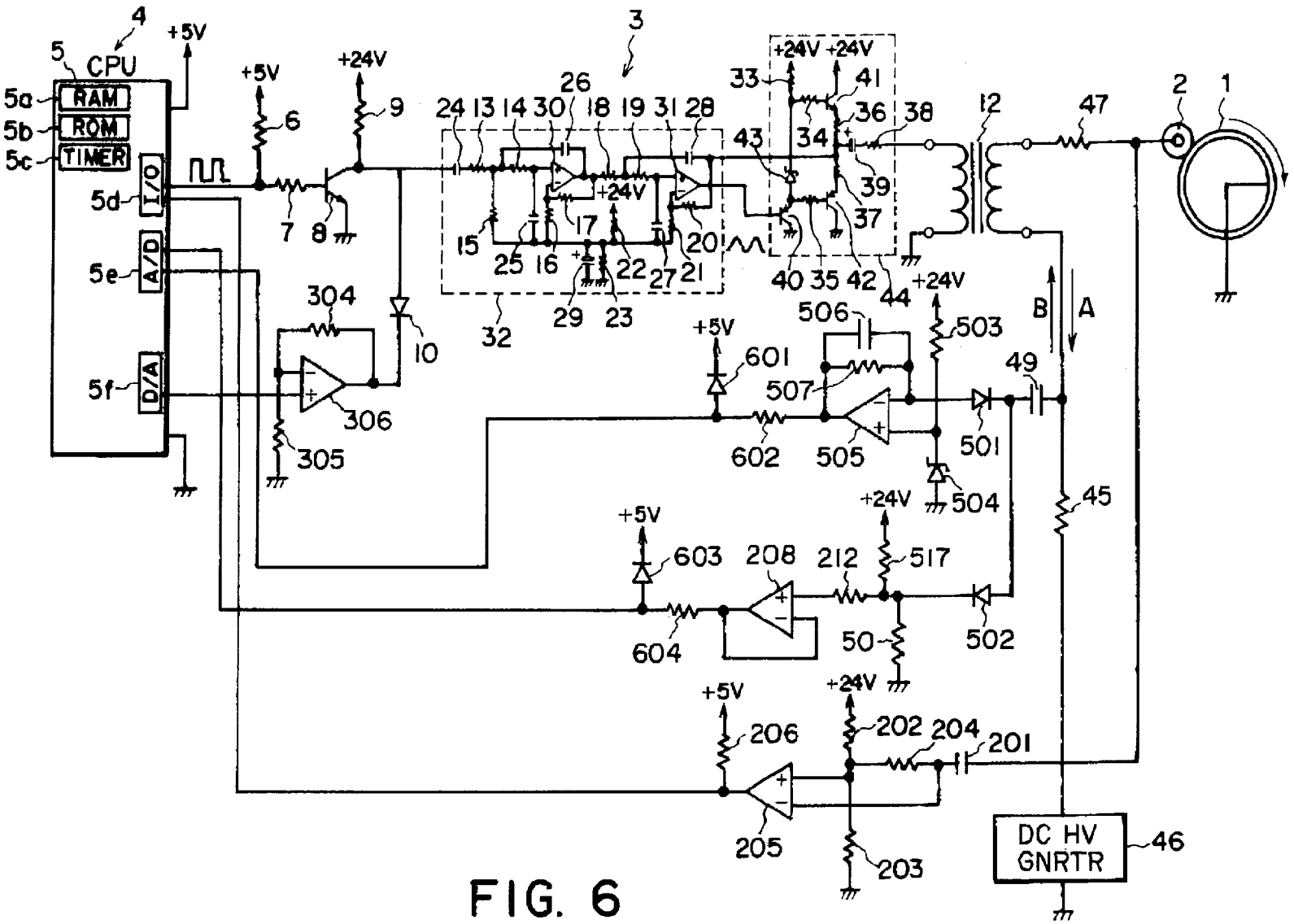
FIG. 6 shows a circuit of a high voltage source according to Embodiment 2.

FIG. 6 is a circuit diagram of a high voltage source 3 according to Embodiment 2. The same reference numerals as in Embodiment 1 are assigned to the elements having the corresponding functions, and the detailed description thereof is omitted for simplicity. The structure of the image forming apparatus is similar to that of Embodiment 1, and therefore, the detailed description thereof is omitted for simplicity.

In this embodiment, the output of the comparator 205 is inputted to an external contact at the IO port 5*d* of the CPU5 where an interruption occurs at a rising edge of the input signal, the voltage provided by the current/voltage conversion by the resistor 50 and the resistor 517 is inputted to the input port Be of the CPU5 through a voltage follower constituted by an operational amplifier 208, a protection resistor 604 and a pull-up diode 603 for protection. Furthermore, in this embodiment, the output voltage of an integration circuit constituted by the operational amplifier 505, a resistor 507 and a capacitor 506, is inputted to the A/D of the CPU5 through a protection resistor 602 and a pull-up diode 601 for protection, and the DA output 5*f* of the CPU5 is connected to a cathode of a diode 10 through a non-reversion amplifying circuit constituted by the operational amplifier 306 and the resistors 304, 305. The other structures are the same as with Embodiment 1.

With the above-described circuit structure of this embodiment, the instantaneous current at the time when the output voltage is minimum and the average current are detected by the CPU5, and in accordance with the result of the detection, the output voltage of the DA output 5*f* of the CPU5 is adjusted, such that instantaneous current in the phase in which the output voltage is minimum or the averaging current can be controlled at a predetermined level.

Figure 7A:
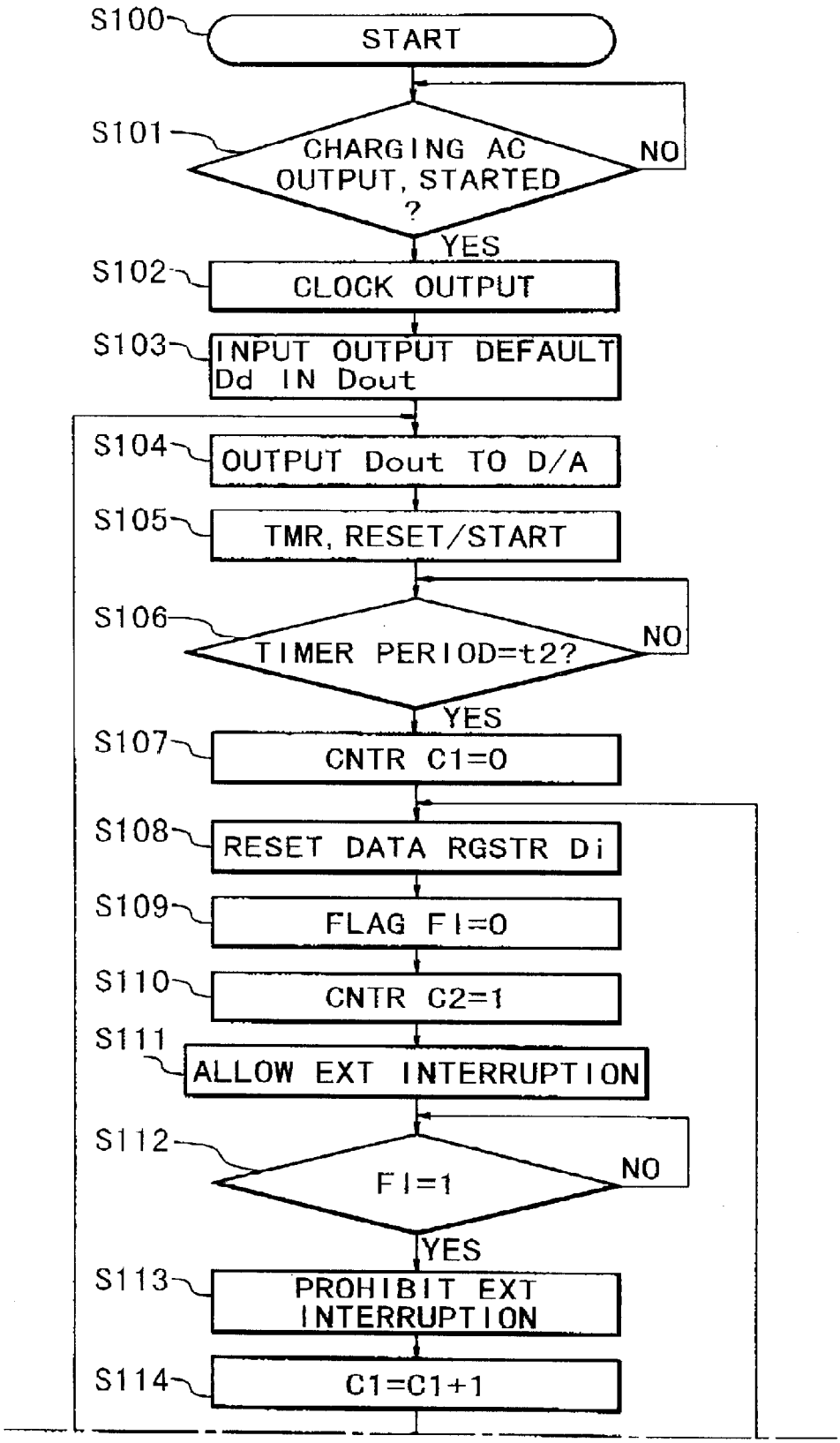
FIGS. 7A and 7B depict a flow chart of control in embodiment 2.
Figure 7B:
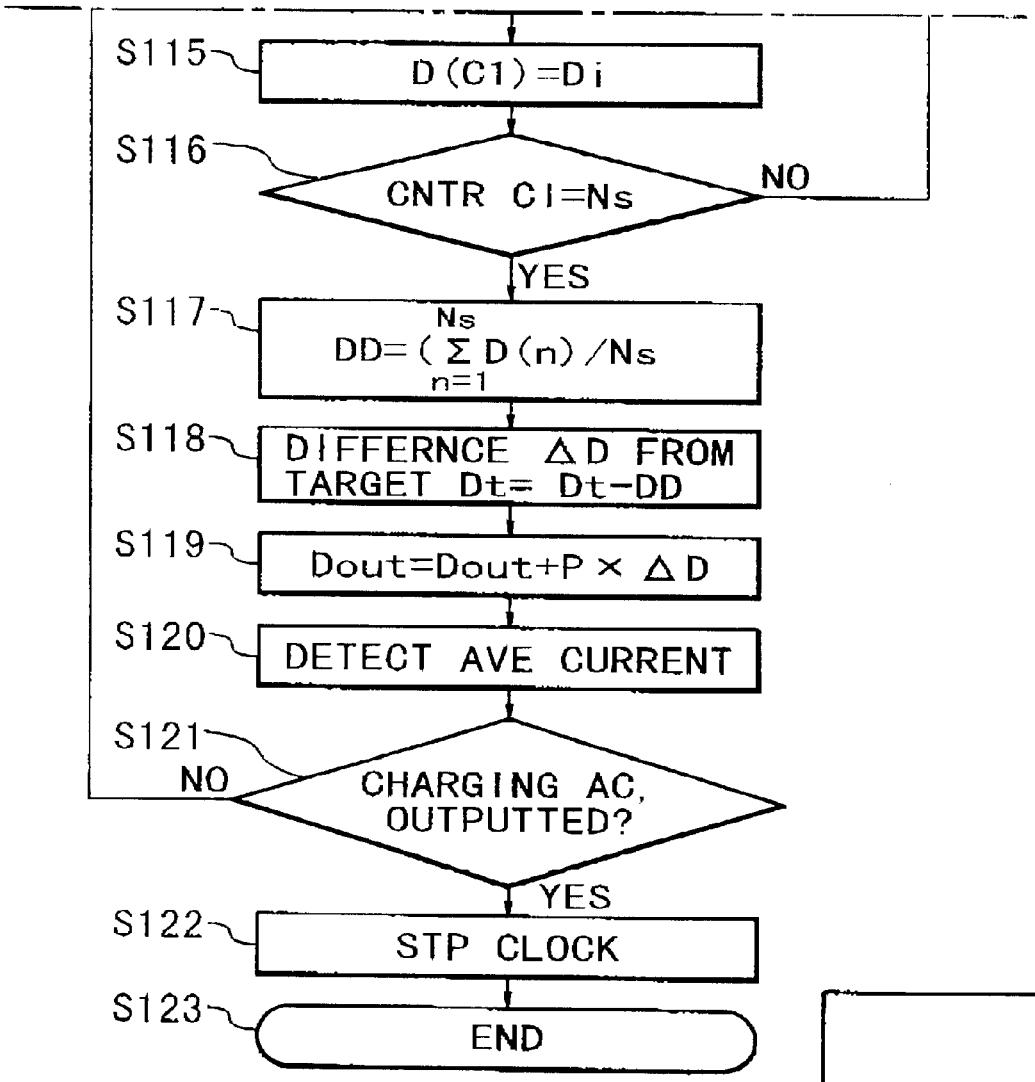
Figure 7:
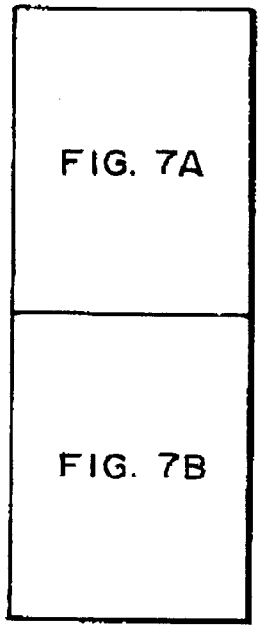
Figure 8:
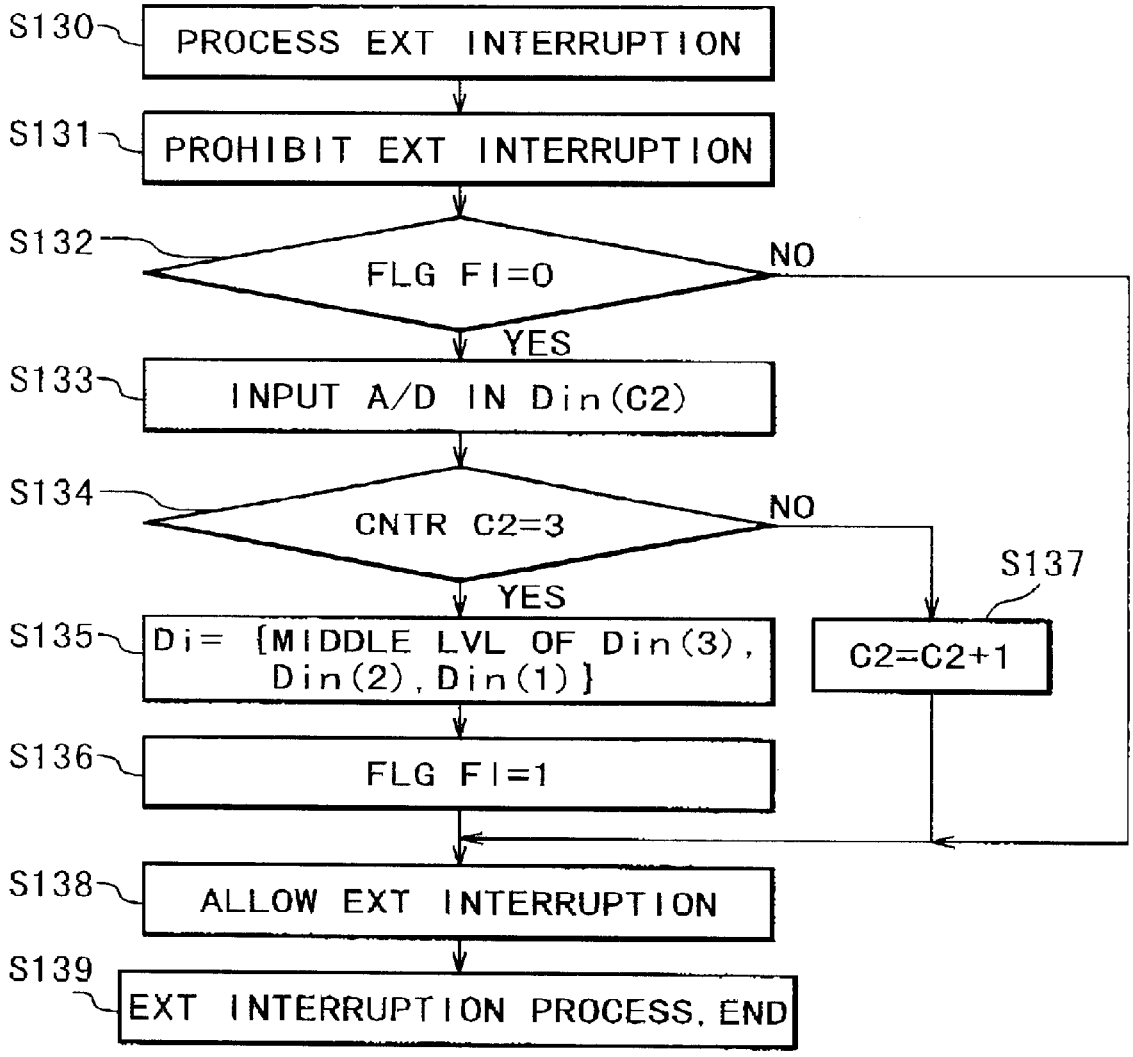
FIG. 8 is a flow chart of a control in Embodiment 2.
Figure 9:
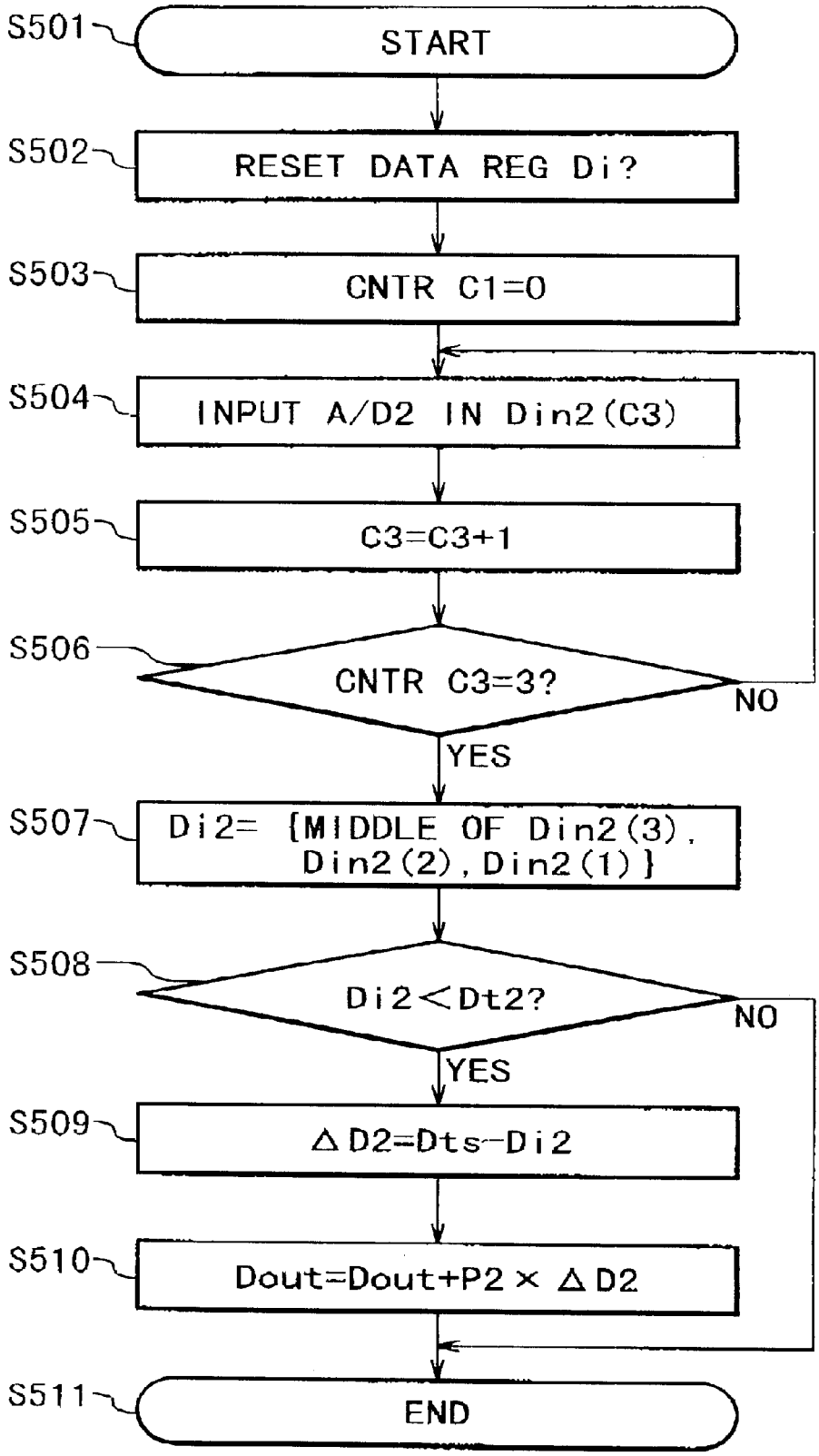
FIG. 9 is a flow chart of a control in Embodiment 2.

Referring to FIGS. 7, 8, 9 (flow charts) and 10 (timing chart), the control in this embodiment will be described.

At a step S100, the main program for the charging AC output is started. First, the CPU5 discriminates whether to start the charging AC output (step S101). If the result of discrimination is affirmative, the clock is outputted (step S102), and then a default value Dd for the D/A port output is inputted to the Dout in order to reduce the time period until the outputing current is rendered to be a set level (step S103), and the Dout is outputted to the DA port (step S104).

For the purpose of waiting from the change of the voltage output of the D/A until the output of the high voltage transformer 12 is stabilized (t2 sec), the timer is reset and started by a timer 5*c* of the CPU5 (step S105), and the elapse of time period t2 is awaited (step S106). When the time period t2 sec elapses, a counter C1 for counting the number of sampling operations is reset to 0 (step S107), and a data register Di for storing the result of A/D input having been process by an external interruption, which will be described hereinafter, is reset (step S108). Thereafter, a flag F1 indicative of the completion of the storing of the Di value is reset (step S109).

In order to remove noise or the like, one sampling operation includes three A/D reading operations, and the intermediate one of the three data (the maximum and the minimum are omitted). The counter C2 for counting the reading operations is set to 1 (step S110), and then the external interruption is permitted (step S111).

When the external interruption is permitted at step S111, the external interruption process is started as shown in FIG. 8 (step S130). First, when the flag F1 is zero, and therefore, Di value has not yet been stored after the prohibition of the external interruption (step S131), the value read in through the A/D input port is inputted into the Din (C2) (step S133).

The discrimination is made as to whether or not the count of the counter C2 is 3 (step S134) to check whether the three reading operations are completed, and if the count is not 3, the counter C2 is incremented by 1 (step S137), and the flag F1 is set to 1 (step S136). Then, the external interruption is permitted (step S138), and the interruption process is terminated. If the flag F1 is other than zero at step S132, the external interruption is permitted (step S138), and the interruption process is terminated (step S139).

After the completion of the external interruption process, the external interruption is prohibited when the flag F1 becomes 1 at step S112 in FIG. 7 (step S113), and the counter C1 is incremented by 1 (step S114). Di is inputted into D (C1) (step S115), and then the discrimination is made as to whether or not Cl is Ns to check whether the Ns times sampling operations are completed (step S116). If C1 is other than Ns at step S116, the resetting of the data register Di is repeated from the process of step S108. If the Ns times sampling operations are completed, an average DD of the Ns sampling data D1 (1) –D1 (Ns) is calculated (step S117). Then, a difference δD1 between the average DD and the target value Dt is calculated (step S118), the difference δD1 is multiplied by a proportional coefficient P1, and the resultant value is added with D out value, and the resultants a renewed Dout (step S119).

Then, at step S120, an average current detection process shown in a flow chart of FIG. 9 is carried out When the average current detection process is started (step S501), the data register Di2 for storing the input result of the A/D is first rest (step S502), and the counter C1 for counting the number of sampling operations for the averaging current east reset (step S503) The value in the A/D2 is inputted into the Din2

(C3) (step S504), and the counter C3 ease incremented by 1 (step S505). If C3 ease 3 (step S506), the intermediate value of the data (provided by removing the maximum value and the minimum value of the three average current detection values Din2 (1), Din2 (2) and Din2 (3)) is stored in Di2 as the average current detection value (step S507).

The comparison is made between the average current Di2 detected at step S508 and the predetermined average current Dt2. When the average current Di2 thus detected is larger than the predetermined average current Dt2, the process is terminated. If the result of the comparison indicates that detected average current Di2 is smaller than the average current Dt2, the difference δD2 between the detected average current Di2 and the predetermined average current Dt2 is calculated (step S509), the Dout is added with the difference δD2 multiplied by the proportional coefficient P2 (step S510), and the average current detection process is completed (step S511).

After the completion of the average current detection process, the discrimination is made as to whether or not the charging AC high voltage output is to be continued at step S121. If it is to be continued, the operation is repeated from step S10. If it is to be stopped, the clock output is stopped (step S122), and the charging AC output process operation ends (step S123).

Figure 10:
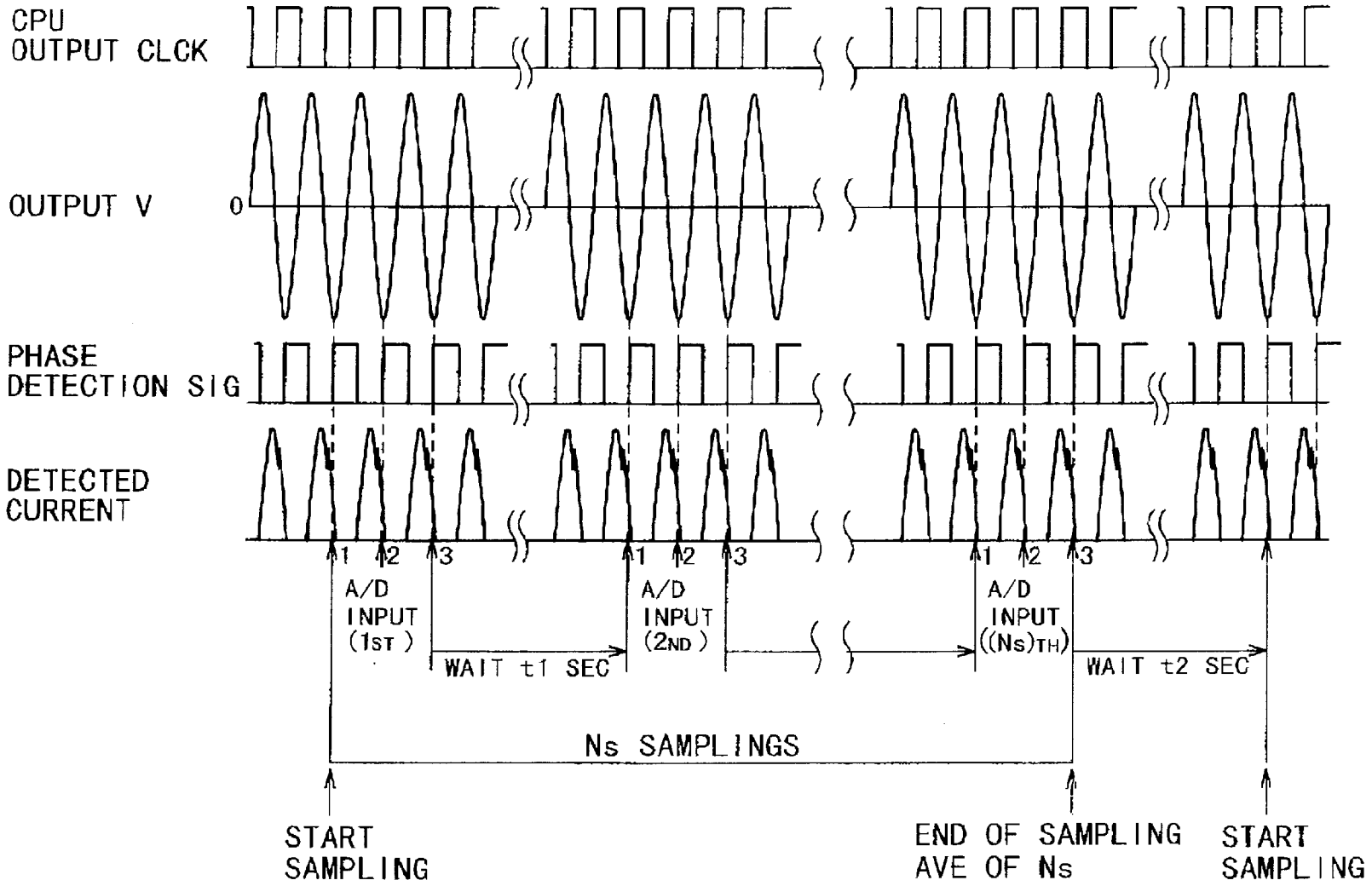
FIG. 10 is a timing chart in Embodiment 2.

By this process operations, as shown in the timing chart of FIG. 10, the three times continuous A/D input operations of the instantaneous current in the phase of the minimum output voltage, is continuously repeated Ns times at t1 sec intervals. On the basis of the result of these operations, the DA output is changed, and thereafter, the sampling operation is started after 2 sec waiting time, and this is repeated. By doing so, the instantaneous current in the phase of the minimum output voltage can be maintained at the predetermined value. Simultaneously with the instantaneous current, the average current detection value is detected, by which if it is discriminated that average current is smaller than the predetermined level, the average current can be made at the predetermined level.

The above-described t1 and Ns are determined such that total of Ns times sampling time periods (approx. t1×Ns) is longer than the time period required by one halt rotation of the photosensitive drum 1 and such that t1 is shorter than the time period required by one full rotation of the charging roller 2. In addition, the interval of the sampling actions of the sampling (approx. t1×Ns+t2 sec) is not a constant multiple of the rotation of frequency of the photosensitive drum 1 or the charging roller 2.

The series of processing for upgrading the instantaneous current and the average current is carried out by the CPU (center portion processing device) 5. This is not limiting, and it can be carried out by DSP (Digital Signal Processor) or the like.

As described in the foregoing, according to these embodiments similarly to the first embodiment, the increase of the discharge current attributable to the condemnation of the charging roller 2 or the like can be prevented even when the integrated number of output prints (integrated number of the image forming operations) increases, and therefore, the scrape of the photosensitive drum 1 can be suppressed, and the service life of the photosensitive drum 1 can be remarkably extended.

Additionally, even when the discharge current lowers after a predetermined period of use, the discharge current is not lower than the predetermined level, and therefore, the image defect attributable to the shortage of the discharge current can be prevented.

Embodiment 3

In this embodiment, the structure of the high voltage source 3 is similar to that of Embodiment 2 shown in FIG. 6, and the detailed description thereof is omitted for simplicity. The structure of the image forming apparatus is similar to that of Embodiment 1 (FIG. 1), and therefore, the detailed description thereof is omitted for simplicity.

Referring to flow charts of FIGS. 11, 12 and timing charts of FIGS. 13, 14, the description will be made as to the control operations in this embodiment. The operations except for the external interruption are the same as with Embodiment 2, and therefore, the external interruption process will be described.

Figure 11:
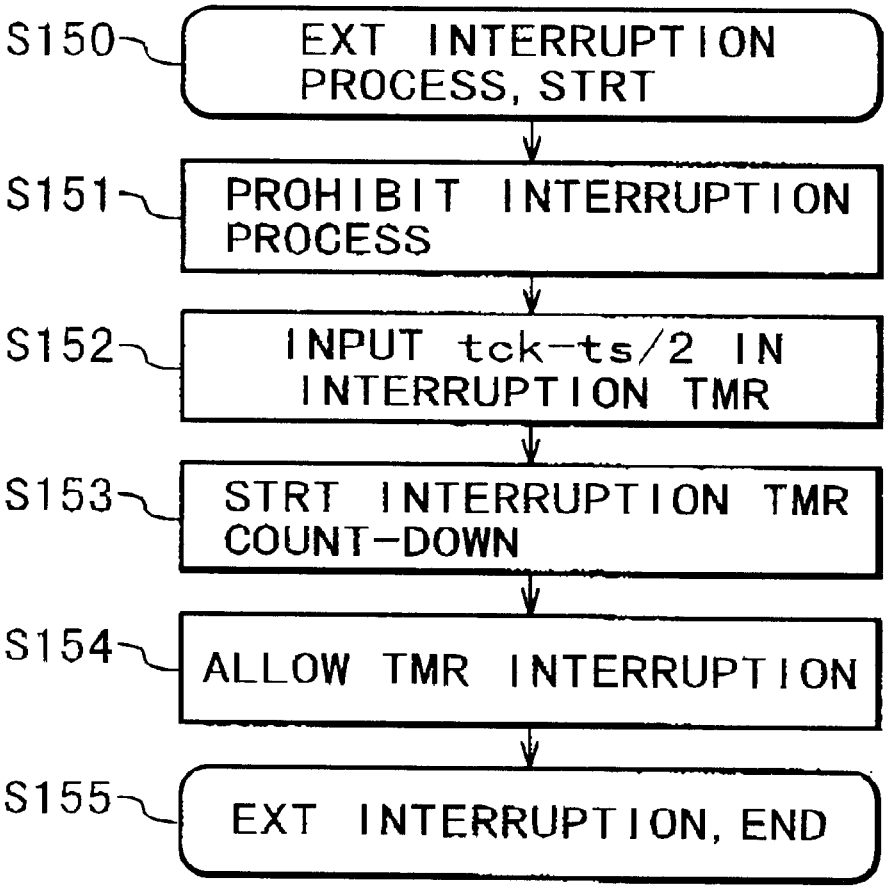
FIG. 11 is a flow chart of a control in Embodiment 3.

As shown in FIG. 11, when the external interruption processes started (step S150), the external interruption is prohibited (step S151), and a predetermined time (tck−ts/2) after that, the interruption timer is set to tack−ts/2 in order to produce a timer interruption using a known down counter (step S152). Here, tack is the time period of 1 cycle of the charging AC voltage (output voltage) shown in FIG. 13, and ts is the time period corresponding to the width of the current detection phase with the center thereof corresponding to the timing at which the output voltage is the minimum. After tck−ts/2 is inputted into the interruption timer, the interruption timer starts counting down (step S153). Then, the timer interruption is permitted (step S154), and the external interruption process is completed (step S155).

Figure 12:
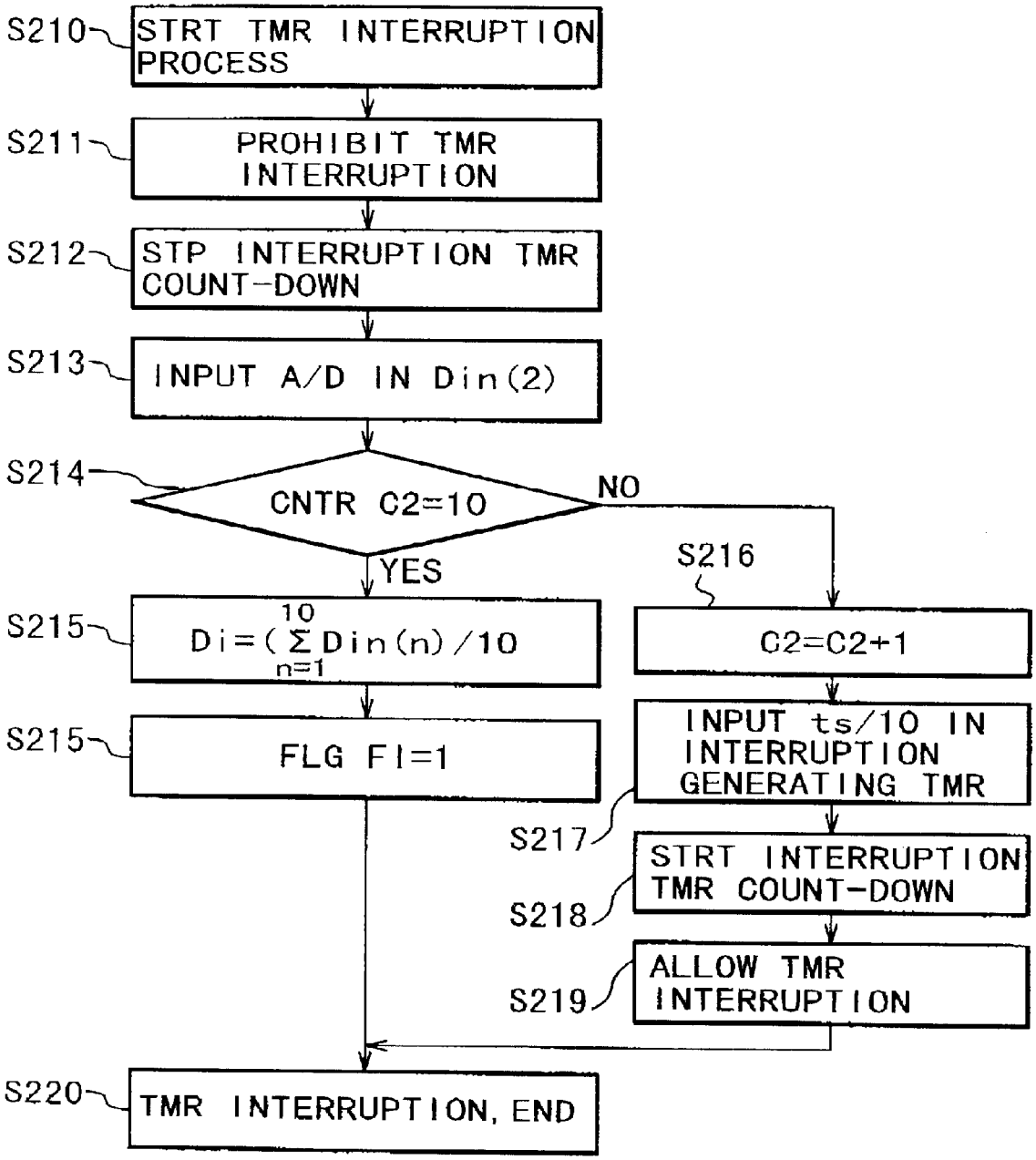
FIG. 12 is a flow chart of a control in Embodiment 3.

Then, when the timer interruption is permitted and step S154, the timer interruption process is started as shown in FIG. 12 (step S210), and the timer interruption is first prohibited (step S211). The counting down of the interruption timer is stopped (step S212), and the reading of the A/D input port is inputted into Din (C2) (step S213).

In other to discriminate as to whether or not a 10th input reading actions have been completed in the period of ts sec, it is discriminated whether the counter C2 has the value 10 or not (step S214). If not, the counter C2 is incremented by 1 (step S216).

Then, the time period ts/10 until the next time interruption is inputted into the interruption producing timer (step S217), and the counting down of the interruption time is started (step S218). After the timer interruption is permitted (step S219), the timer interruption process is completed (step S220).

On the other hand, at step S214, if the count of the counter C2 is 10, the average of (1) −Din is inputted into Di (step S215), and 1 is inputted into the flag F1 (step S215). Then, the timer interruption process is completed (step S220).

Figure 13:
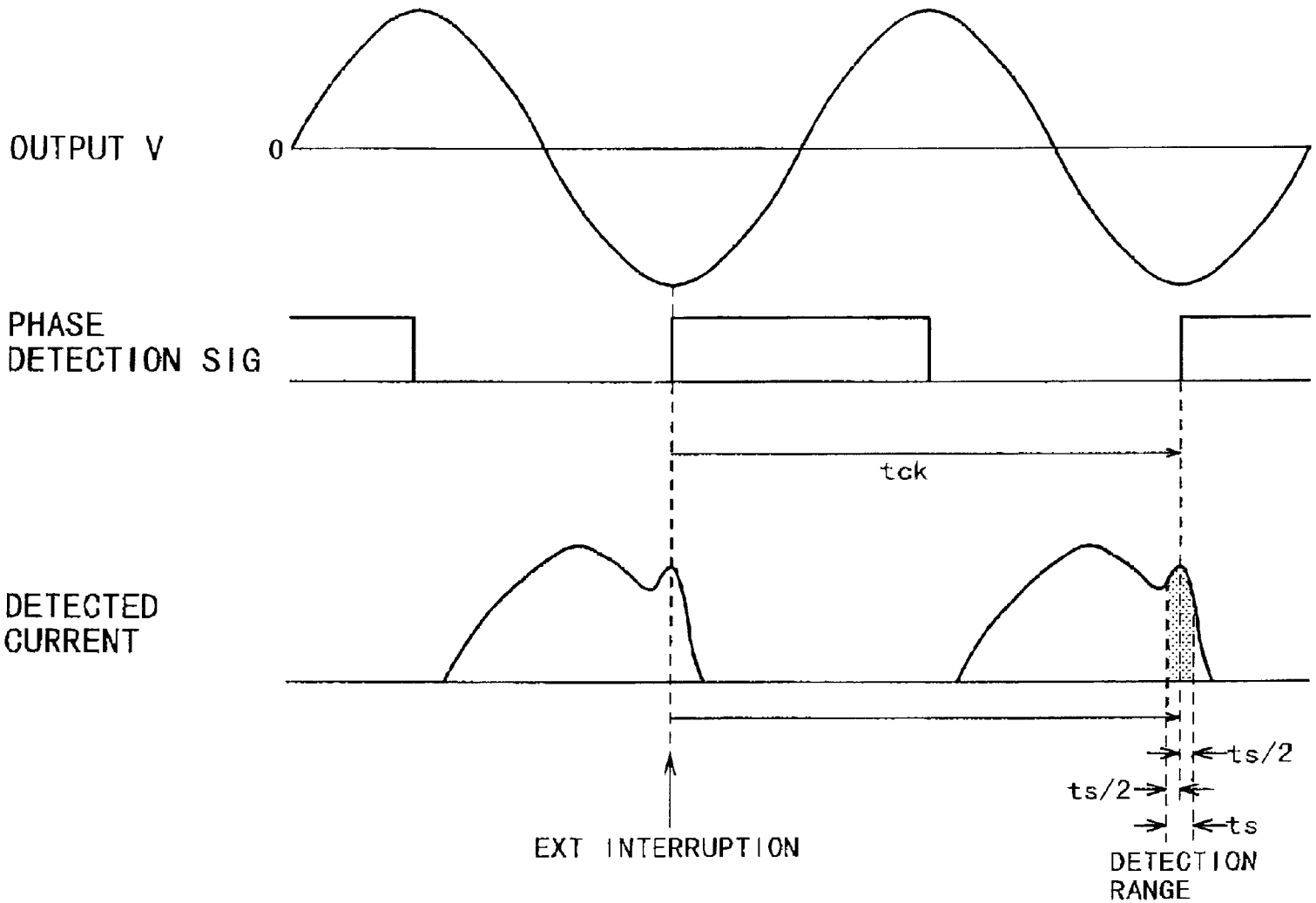
FIG. 13 is a timing chart of a detected current relative to an output voltage.
Figure 14:
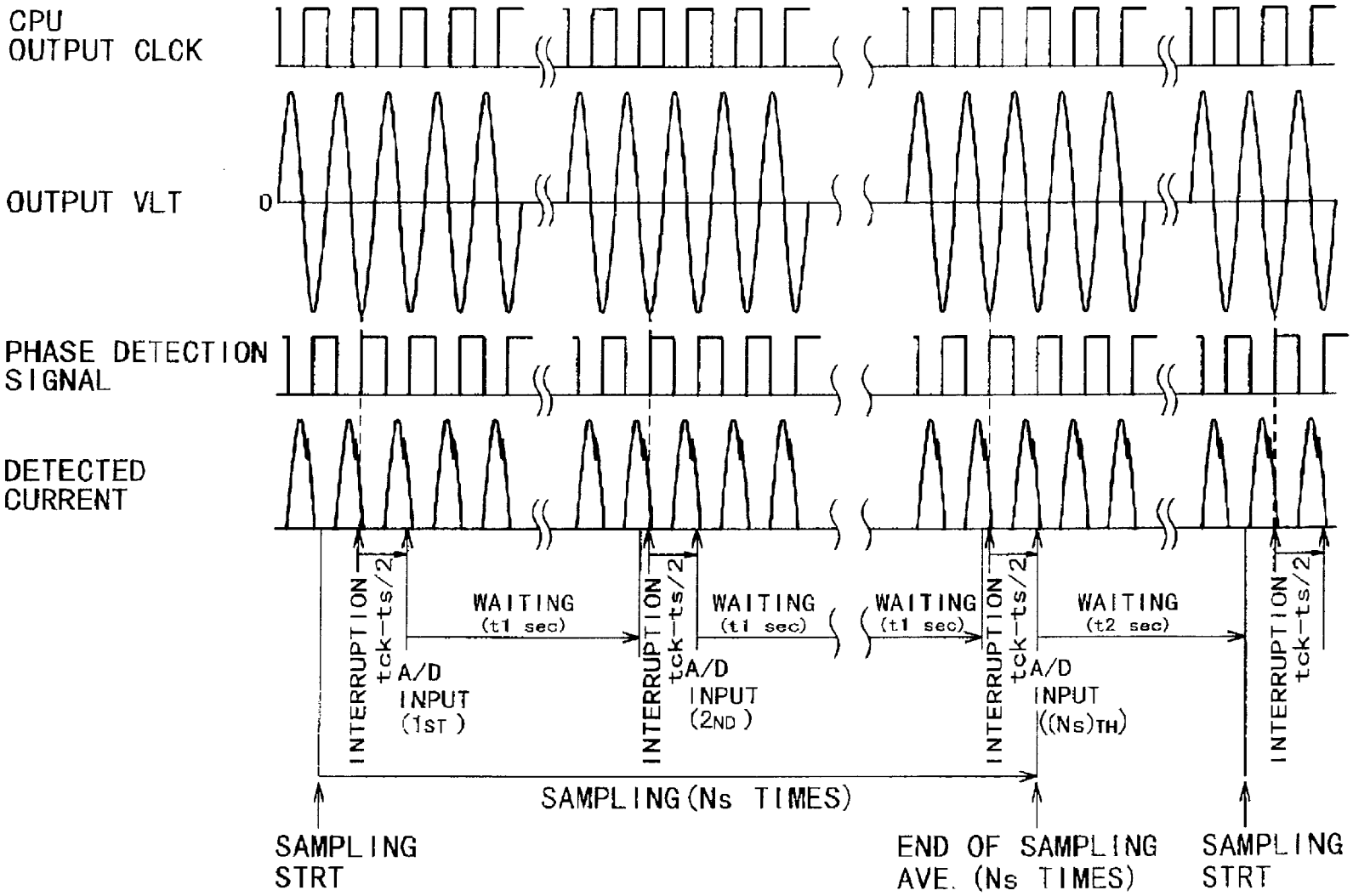
FIG. 14 is a timing chart in Embodiment 3.

By this process operations, as shown in FIG. 13, ten times operations of the detection and averaging for the current from the A/D in the time width ts with the center corresponding to the minimum of the output voltage as shown in FIG. 13 is repeated Ns times at the time intervals of t1 sec, as shown in FIG. 14. On the basis of the result of the operations, the DA output is changed, and thereafter, the sampling operation is started after the waiting period t2. The operations are repeated by which the averaging current in the time width ts with the center thereof corresponding to the phase of the minimum output voltage can be maintained at the predetermined value. Simultaneously with the something of the averaging current during the time width ts, the average current detection value is detected, by which when it is discriminated that average current is lower than the predetermined level, the average current can be controlled to the predetermined level.

As described in the foregoing, according to these embodiments similarly to the first embodiment, the increase of the discharge current attributable to the condemnation of the charging roller 2 or the like can be prevented even when the integrated number of output prints (integrated number of the image forming operations) increases, and therefore, the scrape of the photosensitive drum 1 can be suppressed, and the service life of the photosensitive drum 1 can be remarkably extended.

Additionally, even when the discharge current lowers after a predetermined period of use, the discharge current is not lower than the predetermined level, and therefore, the image defect attributable to the shortage of the discharge current can be prevented.

Embodiment 4

Figure 15:
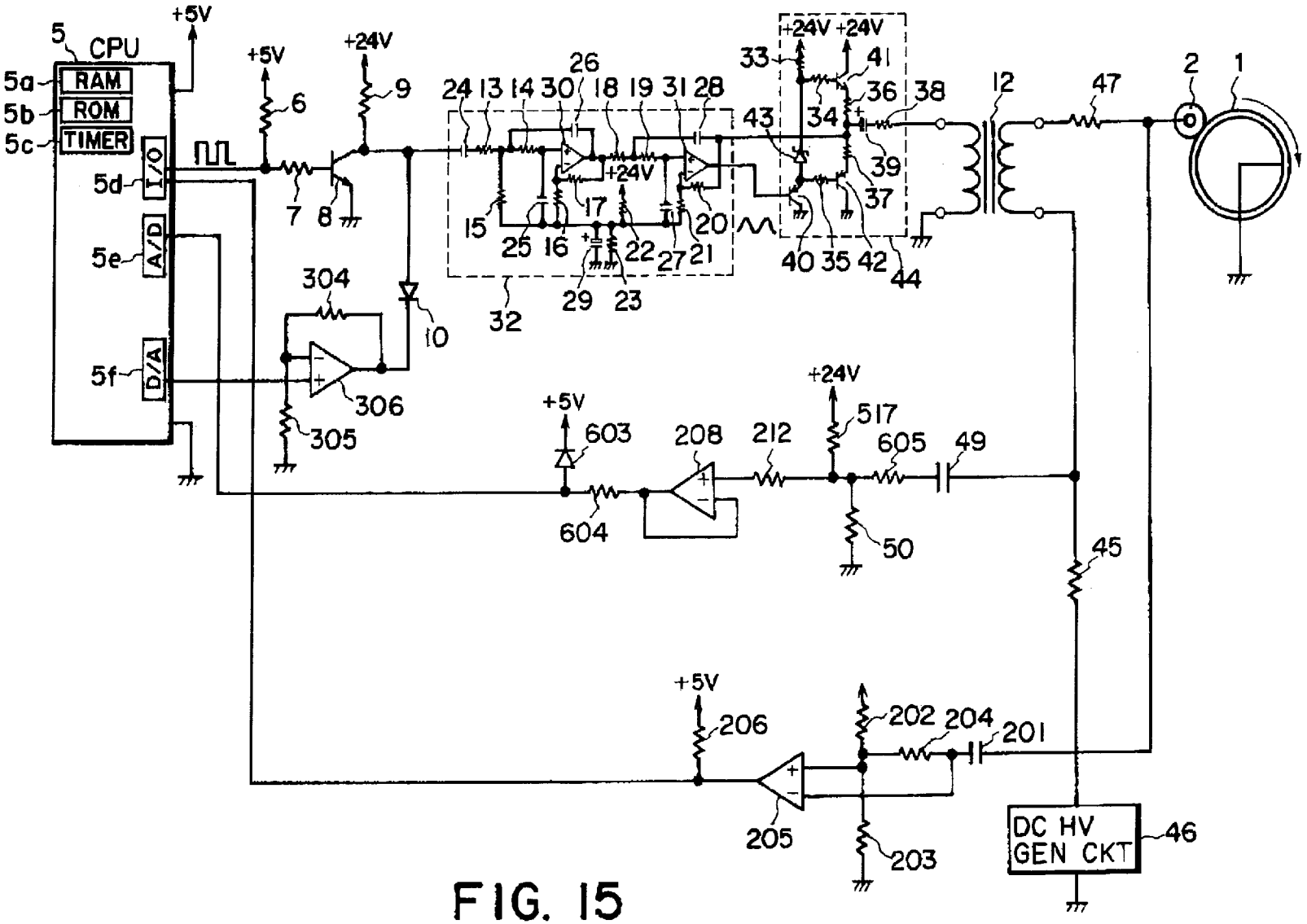
FIG. 15 shows a circuit of a high voltage source according to Embodiment 4.

FIG. 15 is a circuit diagram of a high voltage source 3 according to Embodiment 2. This embodiment is similar to Embodiment 2 except that there is not provided the integration circuit (average current detecting circuit) for the average current detection in the circuit of Embodiment 2 shown in FIG. 6, and therefore, the detailed description is omitted for the common parts for simplicity. The structure of the image forming apparatus is similar to that of Embodiment 1 (FIG. 1), and therefore, the detailed description thereof is omitted for simplicity.

In this embodiment, the instantaneous current when the output voltage is the minimum and the average current are detected by CPU5, and on the basis of the result of detection, the output voltage of the DA output 5*f* of the CPU5 is adjusted, so that instantaneous current or the averaging current in the phase in which the output voltage is the minimum is controlled to be at the predetermined level.

Figure 16A:
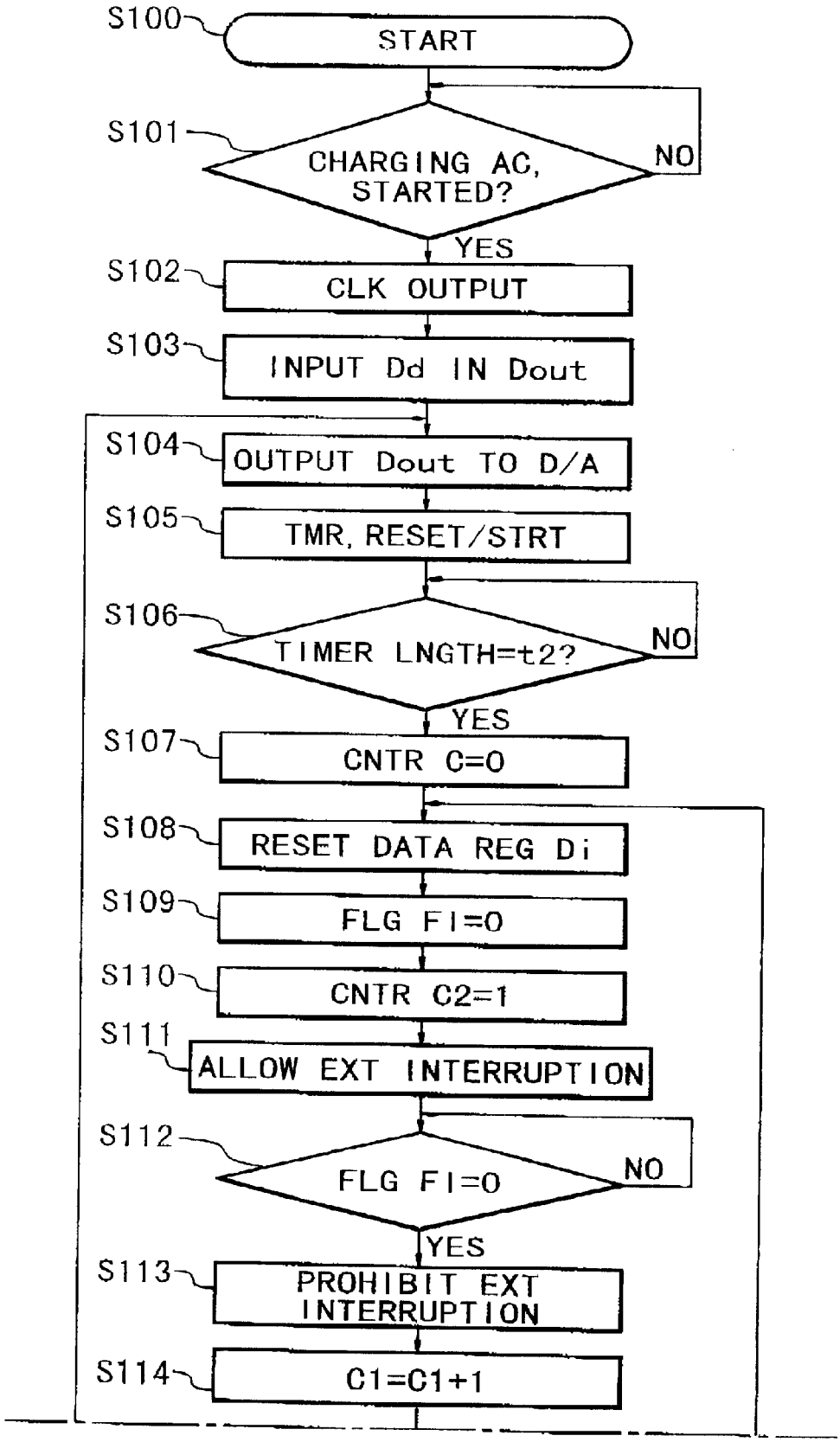
FIGS. 16A and 16B depict a flow chart of control in embodiment 4.
Figure 16B:
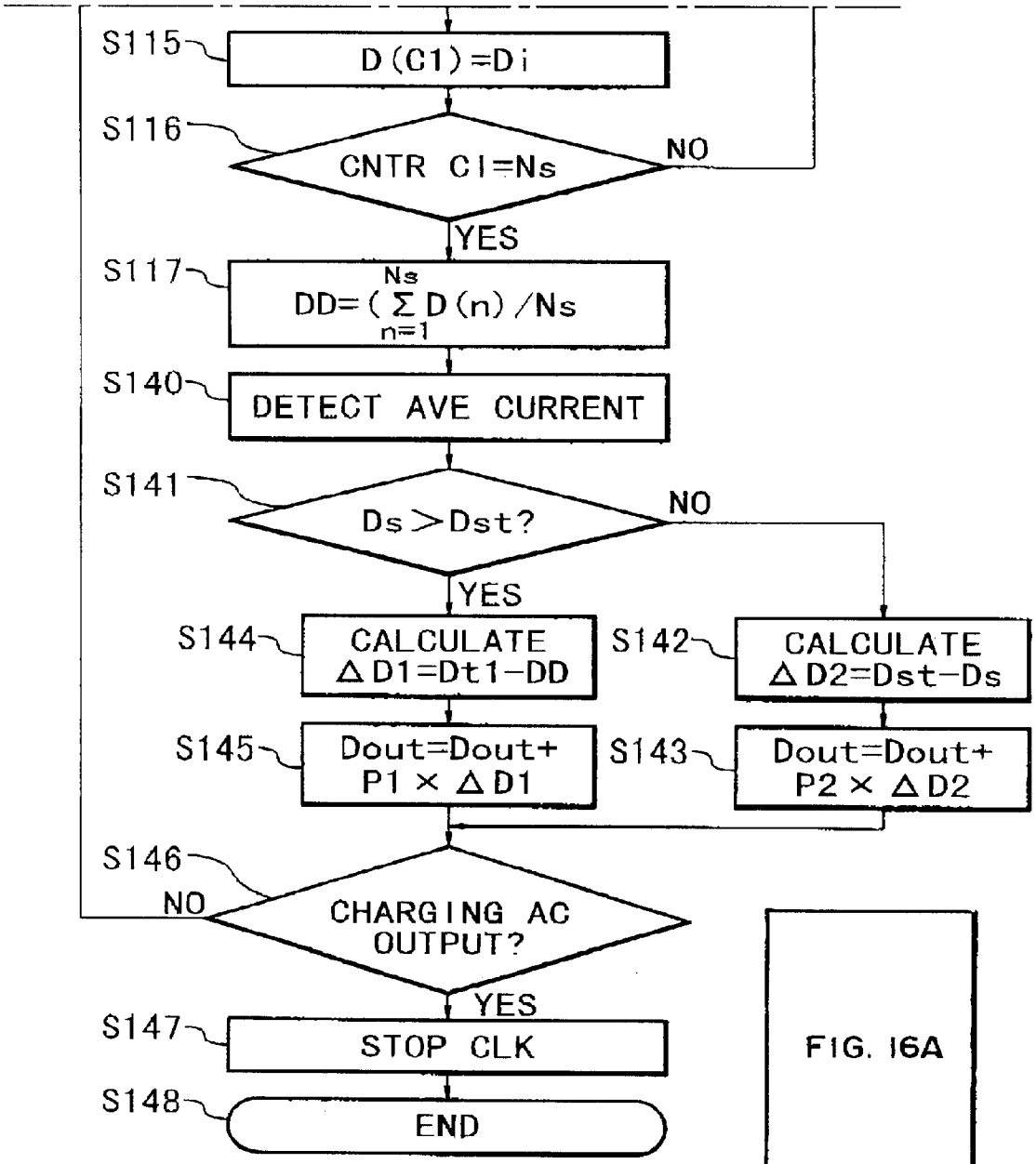
Figure 16:
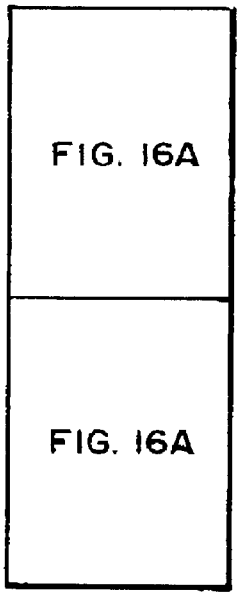

Referring to flow charts of FIGS. 16, 17, the control operation in this embodiment will be described. In FIG. 16, the operations in step S100 are the same as with Embodiment 2, by which the instantaneous current is detected, and in the next step, that is, step S140, the following average current detection process operations are carried out.

Figure 17:
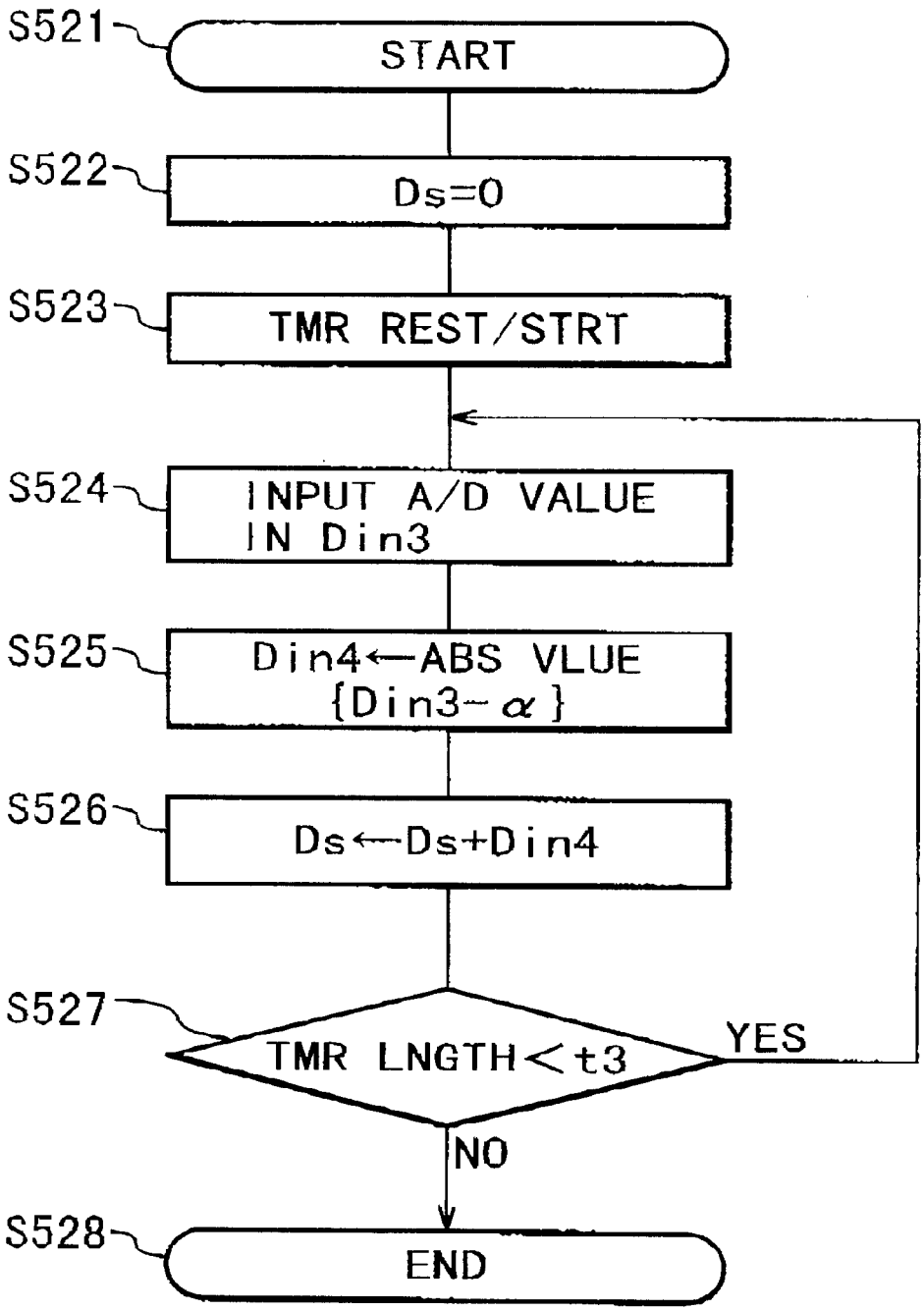
FIG. 17 is a flow chart of a control in Embodiment 4.
Figure 18:
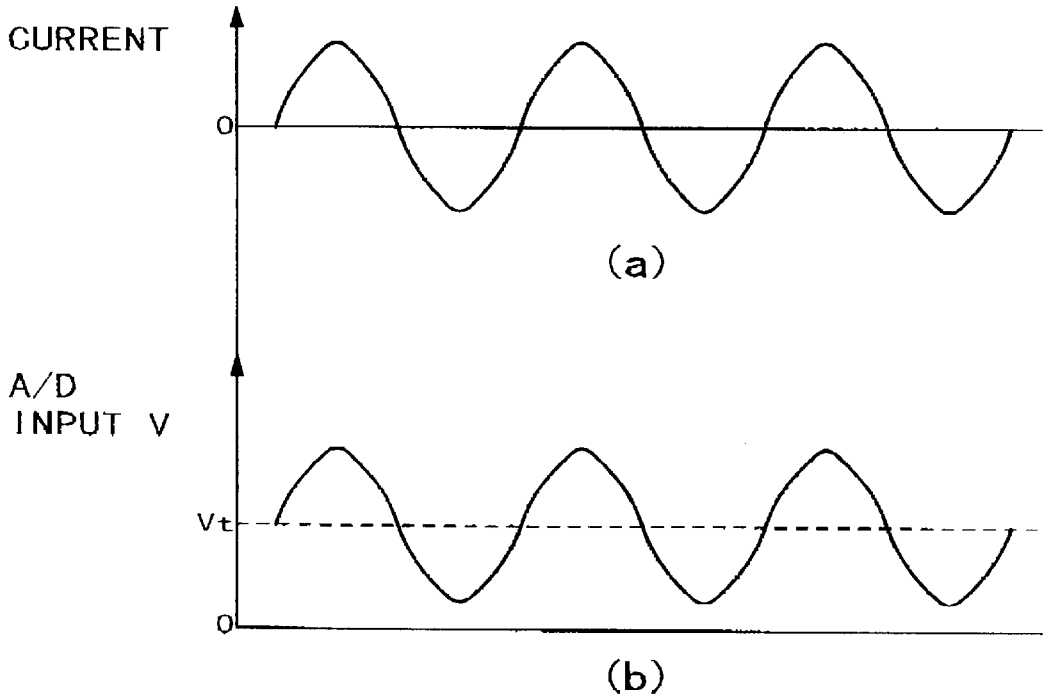
FIG. 18 shows changes in a current into a high voltage source (a) and an input voltage to an AD contact of CPU (b) in Embodiment 4.
Figure 19:
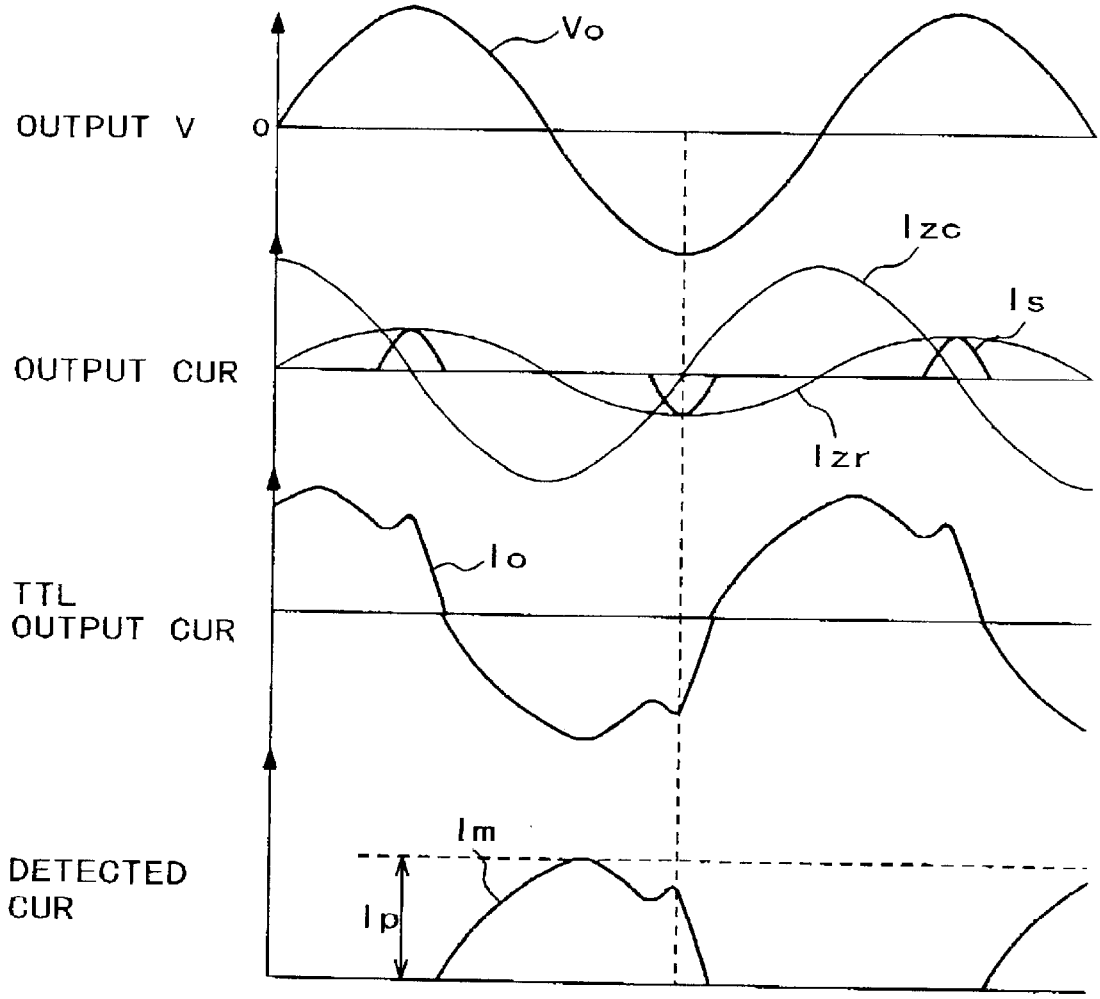
FIG. 19 shows waveforms of an output voltage (AC voltage) and a current applied to a charging roller.
Figure 20:
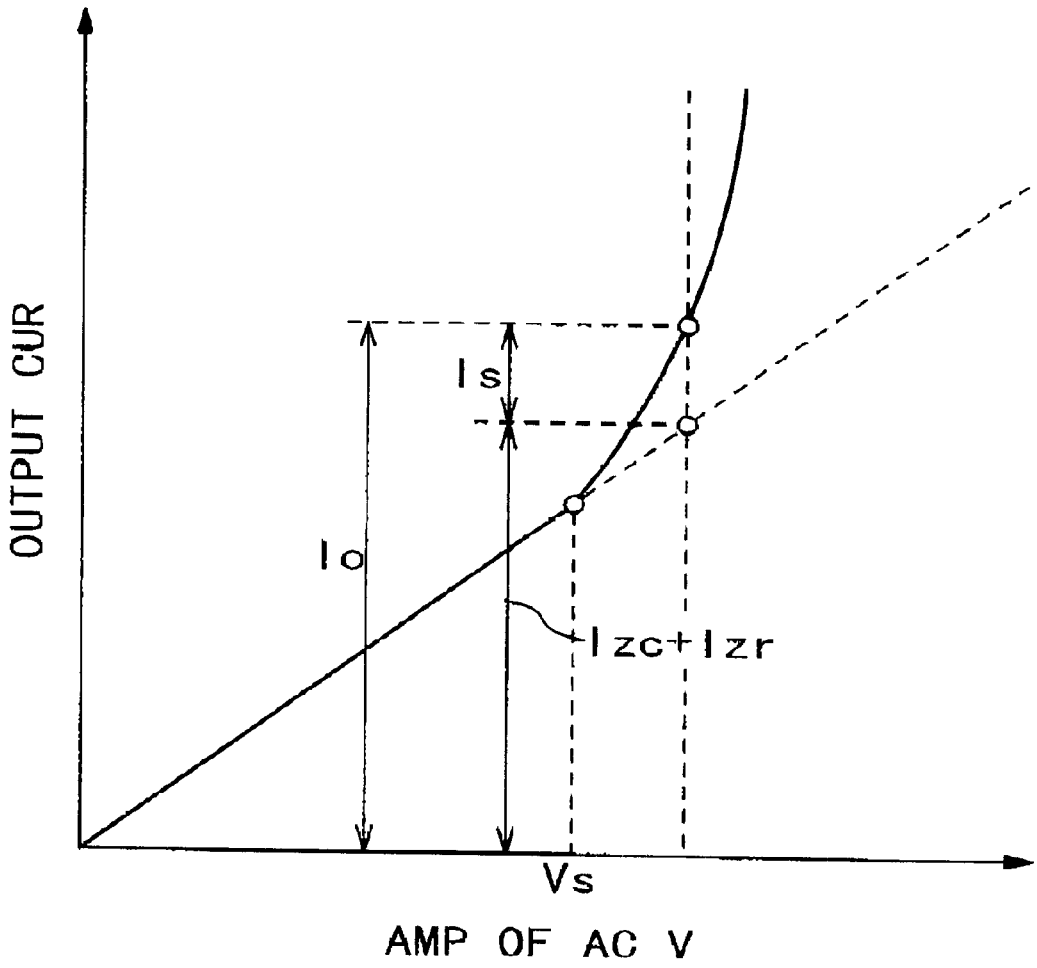
FIG. 20 shows a relation between an AC voltage (AC voltage amplitude) and an AC current (output current) applied to a charging roller.

As shown in FIG. 17, when the average current detection process is started (step S521), a data register Ds for storing an integrated value of the current is reset (step S522), and the timer operation is started after the resenting (step S523). The AD value is inputted into the reading data register Din3 (step S524), and the absolute value of the difference between the Din3 and an offset value a of the voltage output of the operational amplifier 208 into a data register Din4 (step S525). FIG. 18 shows changes of the current toward the high voltage source 3 and the input voltage at the AD contact of the CPU5, and they change with the offset value Vt at the center thereof. the offset value a is provided by digital conversion of voltage Vt.

The value obtained by adding Din4 to the integrated value Ds replaces the integrated value Ds (step S526), and then, the discrimination is made as to whether or not the timer value exceeds the predetermined time t3 (step S527). If not, the operation returns to before the step S524, and if so, the integrated current value Ds obtained by the step S526 is determined, and the average current detection process ends (step S528). By carrying out the above-described said average current detection process, the current integrated for the predetermined period t3, which corresponds to the average current can be calculated.

At step S141 in FIG. 16, the comparison is made between the current integration and a predetermined value Dst to discriminate whether or not the average current Ds is not lower than the predetermined value Dst. If so, a difference δD1 between a target value Dt1 and the average DD is calculated (step S142). Dout is replaced with the current D out value added with the difference δD1 difference δD1 multiplied with a proportional coefficient P1, and the DA voltage output is determined on the basis of the detected value of the instantaneous current (step S143). At step S141, if the average current Ds is lower than the predetermined value Dst, a difference δD2 calculation between the target value Dst and the average current Ds is calculated (step S144), and Dout is replaced with Current D out value added with the difference δD2 difference δD2 multiplied with a proportional coefficient P2, and the DA voltage output is determined on the basis of the detected value of the average current (step S145).

At step S146, the discrimination is made as to whether or not the charging AC high voltage output is to be continued, and if so, the operations from step S104 are repeated. If not, that is, the output is to be stopped, the clock output is stopped (step S147), by which the charging AC output process ends.

As shown in FIG. 10, three continuous A/D inputting operations of the instantaneous current in the phase in which the output voltage is the minimum are repeated Ns times at t1 sec intervals. On the basis of the result of these operations, the DA output is changed, and thereafter, the sampling operation is started after 2 sec waiting time, and this is repeated. By doing so, the instantaneous current in the phase of the minimum output voltage can be maintained at the predetermined value. Simultaneously with the instantaneous current, the average current detection value is detected, by which if it is discriminated that average current is smaller than the predetermined level, the average current can be made at the predetermined level.

As described in the foregoing, according to these embodiments similarly to the first embodiment, the increase of the discharge current attributable to the condemnation of the charging roller 2 or the like can be prevented even when the integrated number of output prints (integrated number of the image forming operations) increases, and therefore, the scrape of the photosensitive drum 1 can be suppressed, and the service life of the photosensitive drum 1 can be remarkably extended.

Additionally, even when the discharge current lowers after a predetermined period of use, the discharge current is not lower than the predetermined level, and therefore, the image defect attributable to the shortage of the discharge current can be prevented.

According to this embodiment of the present invention, when the average current detection value detected by the average current detecting means is larger than the predetermined value, the AC voltage applied to t contact charging member from t charging bias applying means such that instantaneous current detection value detected by the instantaneous current detecting means becomes the predetermined value, and therefore, the increase of the discharge current attributable to the condemnation of the charging roller 2 or the like can be prevented even when the integrated number of output prints increases, and therefore, the scrape of the photosensitive drum 1 can be suppressed, and the service life of the photosensitive drum 1 can be remarkably extended.

When the average current detection value detected by the average current detecting means is smaller than the predetermined value, the AC voltage applied to the contact charging member from the charging bias applying means such that average current detection value detected by the average current detecting means becomes the predetermined value, and therefore, even when the discharge current lowers after a predetermined period of use, the discharge current is not lower than the predetermined level, and therefore, the image defect attributable to the shortage of the discharge current can be prevented.

The description will be made as to an embodiment by which the discharge current can be detected more accurately.

Embodiment 5

Figure 24:
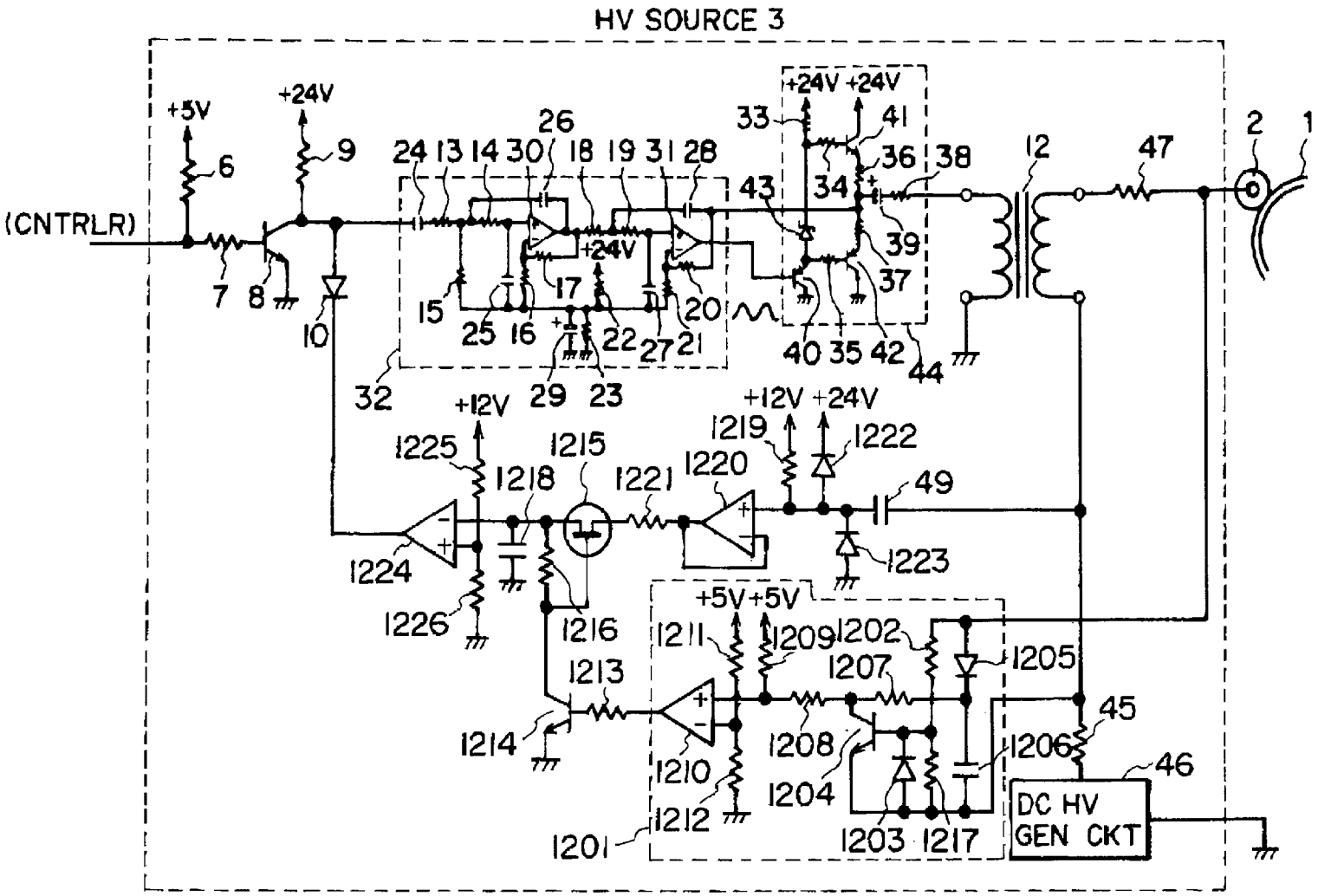
FIG. 24 is a circuit diagram for charging high voltage output control in Embodiment 5.
Figure 25:
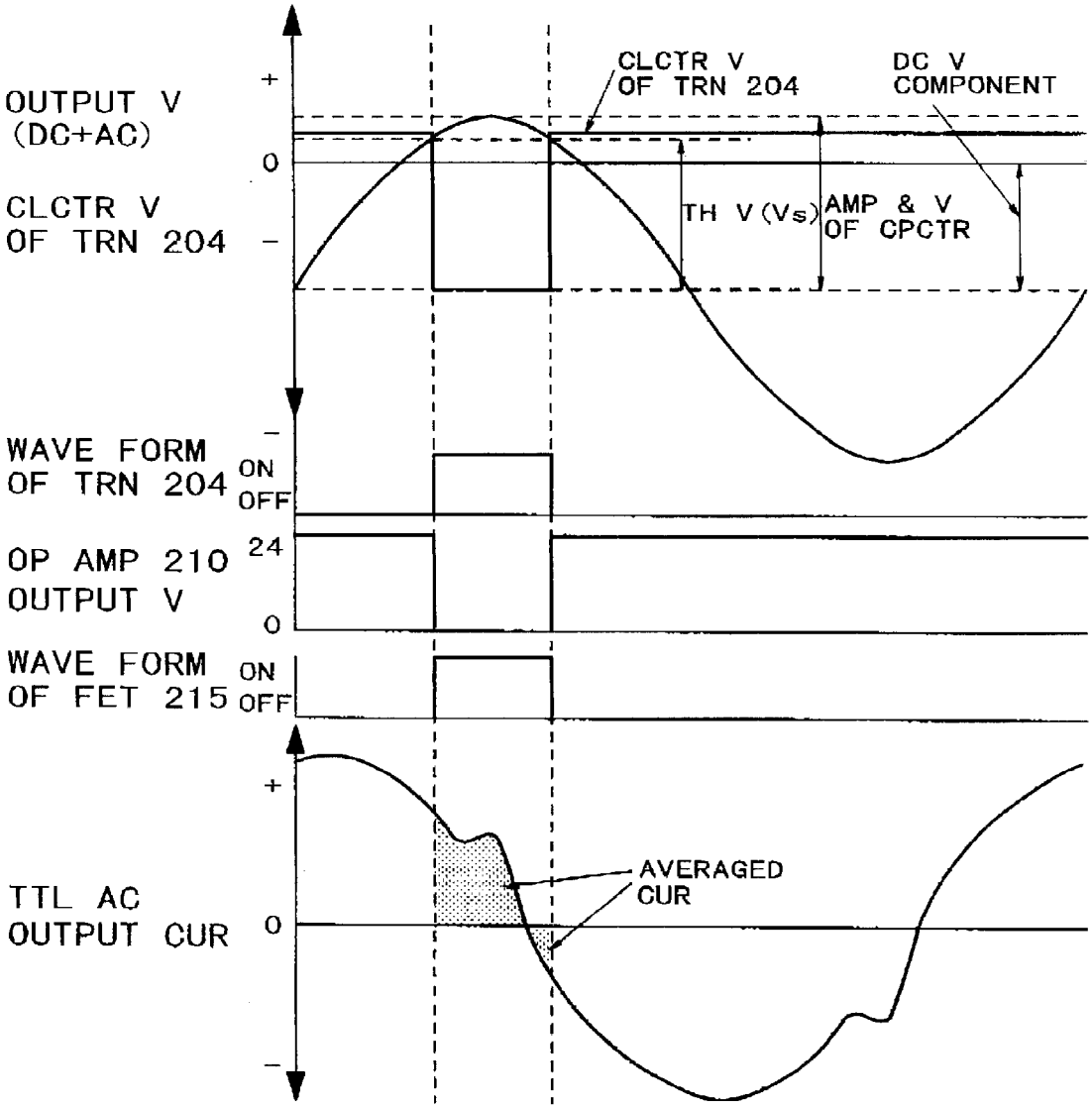
FIG. 25 shows a voltage and current waveforms of a charging high voltage.

Referring to FIG. 24 (circuit diagram) and FIG. 25 (waveform graph), a charging high voltage output control will be described. In FIG. 24, the controller 4, clock generating circuit of the high voltage source portion 3 (resistors 6, 7 and transistor 8), the filter circuit 32, the high voltage transformer drive circuit 44, the high voltage transformer 12, the DC high voltage generating circuit 46 and so on are the same as those of FIG. 2, and therefore, the detailed description thereof is omitted for simplicity.

In the circuit diagram of FIG. 24, designated by 1201 is voltage range detecting means for detecting timing at which a positive voltage amplitude of an AC high voltage applied to the charging roller 2 from the high voltage transformer 12 is not lower than a predetermined voltage (Vs: empirically 500V–1000V). It includes resistors 1202, 1217 which divides the positive voltage amplitude and supplies the divided voltage to the base side of the high voltage resistant transistor 1204, by which the high voltage resistant transistor 1204 operates with the threshold which is equal to the predetermined voltage of positive voltage amplitude. Therefore, as shown in FIG. 25, collector voltage of the high voltage resistance transistor 1204 changes so that it is substantially close to the positive peak amplitude voltage produces across the high voltage capacitor by the DC voltage provided by the high DC voltage generating circuit 46, the high voltage resistant diode 1205 and the high voltage capacitor 1206.

The diode 1203 functions for protection by preventing excessive lowering of the base potential of the transistor 1204 when the output voltage of the high voltage transformer 12 has a negative oscillation.

The collector voltage of the transistor 1204 is divided by a resistor 1208 and a resistor 1209 connected to +5V, and the divided voltage is inputted to the "+" contact of the operational amplifier 1210, and the reference voltage selected by the resistors 1211, 1212 is supplied to the "–" contact, and they are compared. By doing so, the output contact of the operational amplifier 1210 produces a timing signal having an amplitude of approx. +24V in synchronism with the transistor 1204. The operational amplifier shown in FIG. 24 is activated by the power source voltage +24V unless otherwise stated. The resistances of the resistors 1207, 1208 are large enough to retain the charge stored in the capacitor 1206. The output signal of the operational amplifier 1210 is inputted to the base of the transistor 1214 having the emitter grounded through a base resistor 1213, and the collector is connected to the gate of the FET 1215. By doing so, the transistor 1214 is rendered off only at the timing at which the output of the operational amplifier 1210 is Low, namely, the positive voltage amplitude of the AC high voltage is not lower than the predetermined voltage (Vs), and the gate voltage of the FET 1215 is substantially at the same potential as the source voltage because of the resistor 1216 connected between the gate and the source, and therefore, the FET 1215 is rendered on.

To the source side of the FET 1215 is connected a capacitor 1218, and to the drain side is connected a resistor 1219, a voltage follower circuit using the operational amplifier 1220 for impedance conversion of a voltage converted from the AC current by current/voltage conversion using a resistor 1219 and a resistor 1221 constituting an integration circuit with the capacitor 1218. The diodes 1222, 1223 function to protect the operational amplifier 1220 at the input side.

With this structure, an average of the AC current flowing from the high voltage source 3 to the charging roller 2 is detected at the timing at which the positive voltage amplitude of the AC high voltage is not lower than the predetermined voltage (Vs).

The voltage of the capacitor 1218 with which the average current is provided, is inputted to a – contact of the operational amplifier 1224, and a "+" contact is connected with a target voltage provided by voltage division using the resistors 1225, 1226, and they are compared. The output contact of the operational amplifier 1224 indicative of the result of the comparison is fed back to the cathode of the diode 10, by which the average current can be maintained at the target value.

Figure 26:
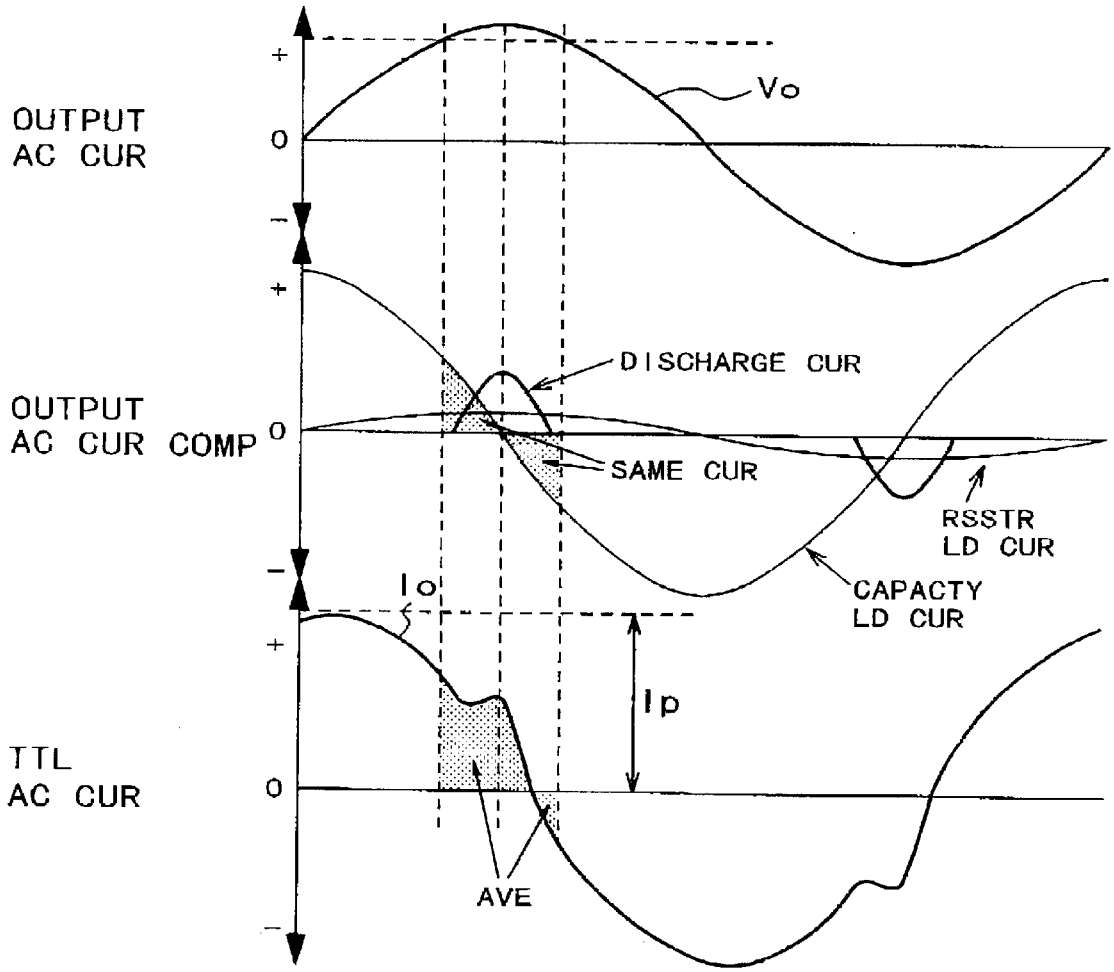
FIG. 26 shows a voltage and current waveforms of a charging high voltage.

As described in the foregoing, the system of this embodiment comprises a photosensitive drum 1 (member to be charged), a charging roller 2 (charge member) provided on the surface of the photosensitive drum, a high voltage source 12 for applying an AC voltage, particularly, a sine wave AC voltage to the charging roller 2, a voltage range detecting means 1201 for detecting a voltage range of the AC voltage applied to the charging roller 2, that is, the voltage range in which the absolute value of the AC voltage is not lower than the predetermined value, for example, the range in which the sine wave AC voltage is not lower than the than the predetermined positive voltage, average current detecting means for detecting an averaging current provided by the high voltage source in the predetermined voltage range of the AC voltage based on the output of the voltage range detecting means, wherein the detected current of the average current detecting means is controlled at a set level by controlling the output of the high voltage source. By this, the outputting current in the voltage phase range with the peak of the voltage amplitude thereof at the center, and therefore, the capacity load current (Izc) which occupies most of the outputting currents as shown in FIG. 26 are offset. Accordingly, the discharge current is accurately detected, and the controlling can be carried out with precision.

In the foregoing, the averaging current detecting means is constituted by the circuit from the capacitor 49 to the capacitor 1218 (49, 1222, 1223, 1219, 1220, 1215, 1218). The means for controlling the output of the high voltage source such that detected current is at a predetermined set level is constituted by the resistors 1225, 1226 setting the set point as a voltage, the operational amplifier 1224 and the diode 10.

Figure 23:
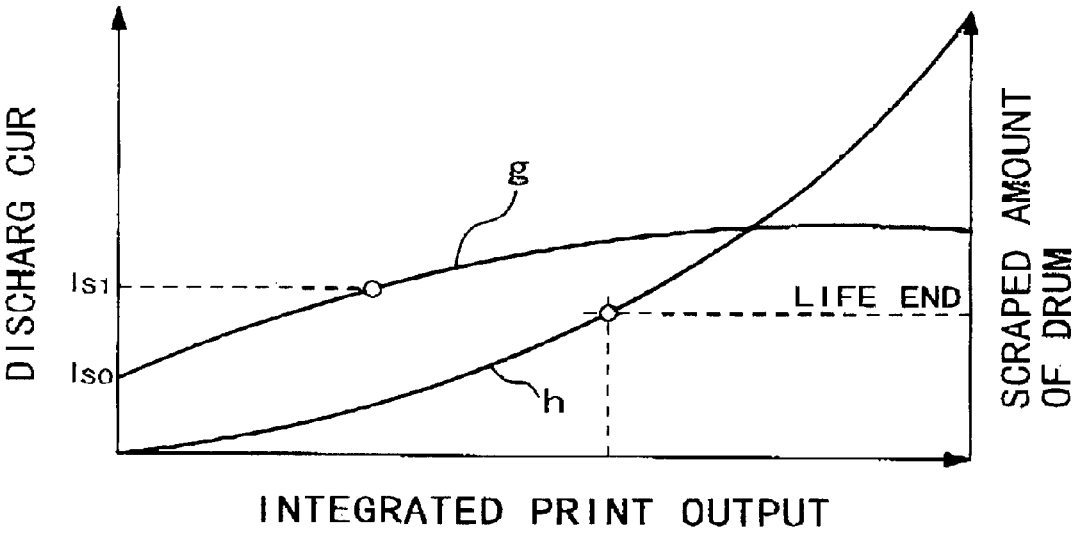
FIG. 23 shows a relation between an integrated number of output prints and a discharge current in a conventional example.
Figure 27:
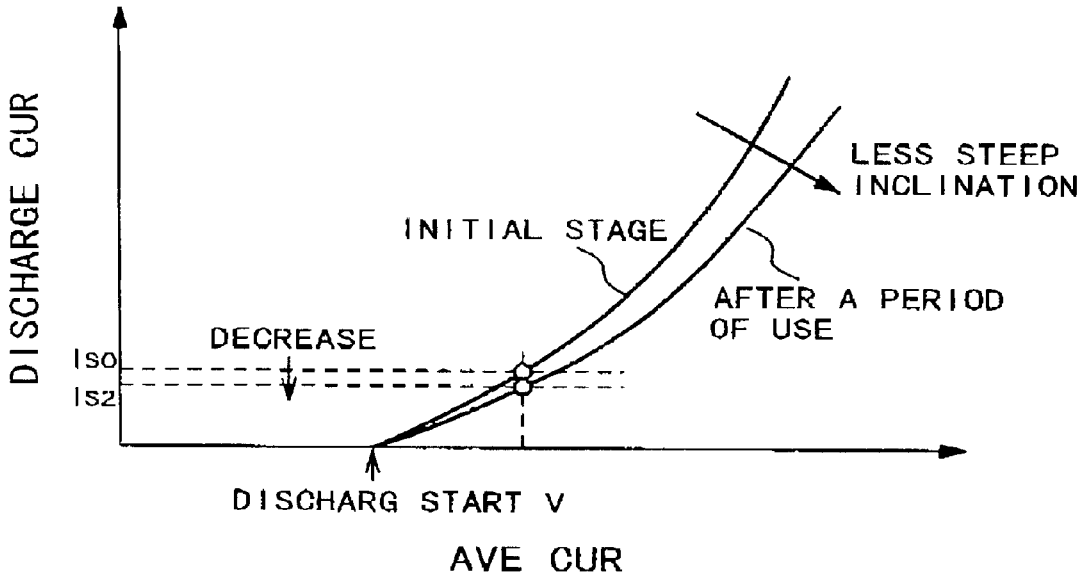
FIG. 27 is a discharge current graph.

As shown in FIG. 27, the characteristics, at the initial stage of use of the charging roller, of the average current and the discharge current in one or both the voltage range in which the sine wave AC voltage is not lower than the predetermined positive voltage and the voltage range in which it is not higher than the predetermined negative voltage, is substantially maintain even after substantial use thereof, or slightly changes such that inclination of the characteristics slightly decreases. Therefore, as shown in FIG. 23, the increase of the discharge current attributable to the condemnation of the charging roller 2 or the like can be prevented even when the integrated number of output prints increases, and therefore, the scrape of the photosensitive drum 1 can be suppressed, and the service life of the photosensitive drum 1 can be remarkably extended.

Embodiment 6

Referring to a control circuit diagram of FIG. 29 and a waveform graph of FIG. 30, the sixth embodiment will be described.

Figure 29:
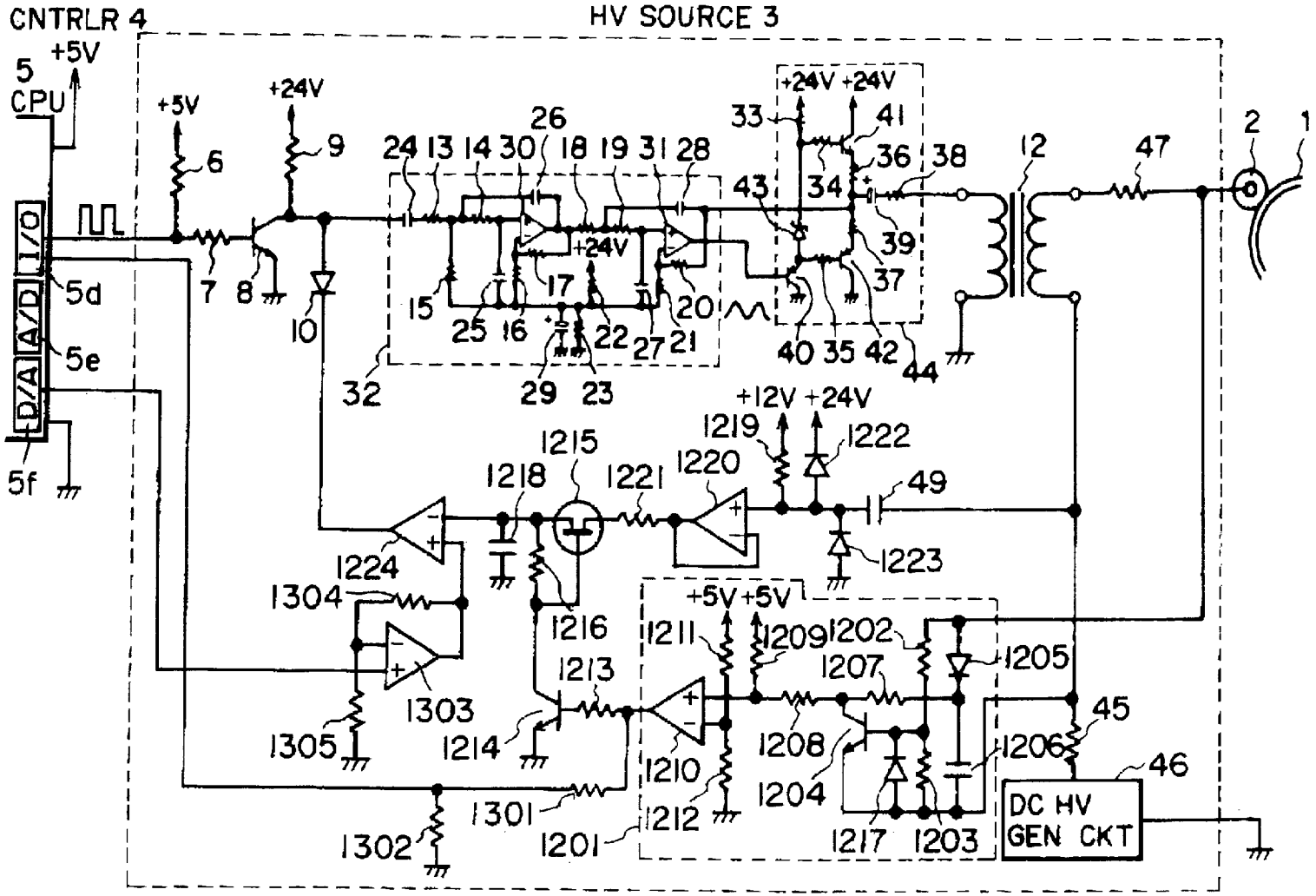
FIG. 29 is a circuit diagram for charging high voltage output control in Embodiment 6.
Figure 30:
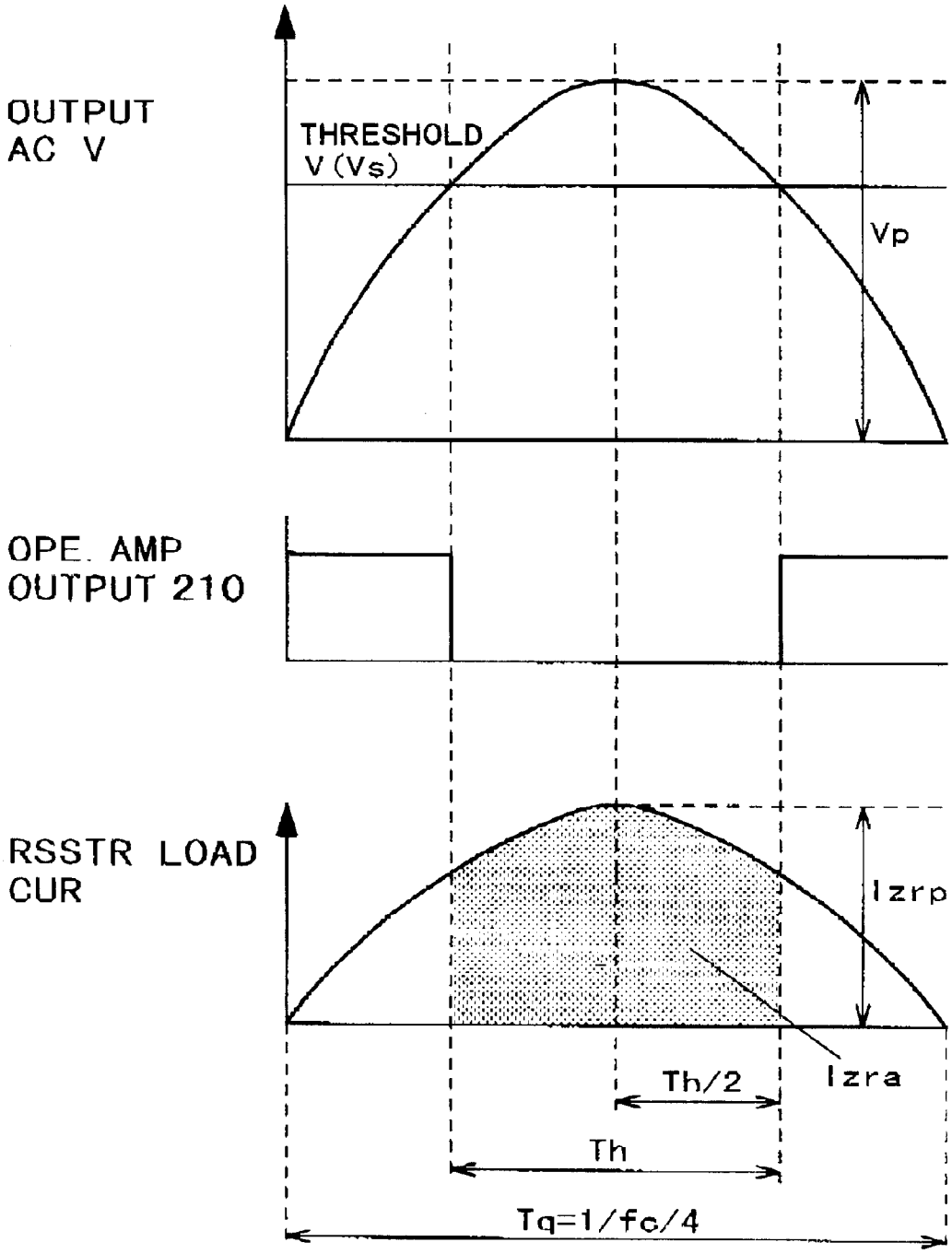
FIG. 30 shows a voltage and current waveforms of a charging high voltage.

The circuit diagram of FIG. 29 is different from the circuit diagram of FIG. 24 (Embodiment 5) in the following points. The output of the operational amplifier 1210 is divided by the resistors 1301, 1302, and the divided voltage is inputted to the IO port 5*d* of the CPU5. By this, the time period (Th in FIG. 30) from the time at which the operational amplifier 1210 produced the Low output to the time at which the positive voltage amplitude of the AC high voltage is not lower than a predetermined voltage (Vs), can be detected. The output of the DA port 5*f* of the CPU5 is connected to the "+" contact of the operational amplifier 1224 through a non-reversing amplifying circuit including an operational amplifier 1303 and resistors 1304, 1305, so that control value of the average current is variable.

Figure 31:
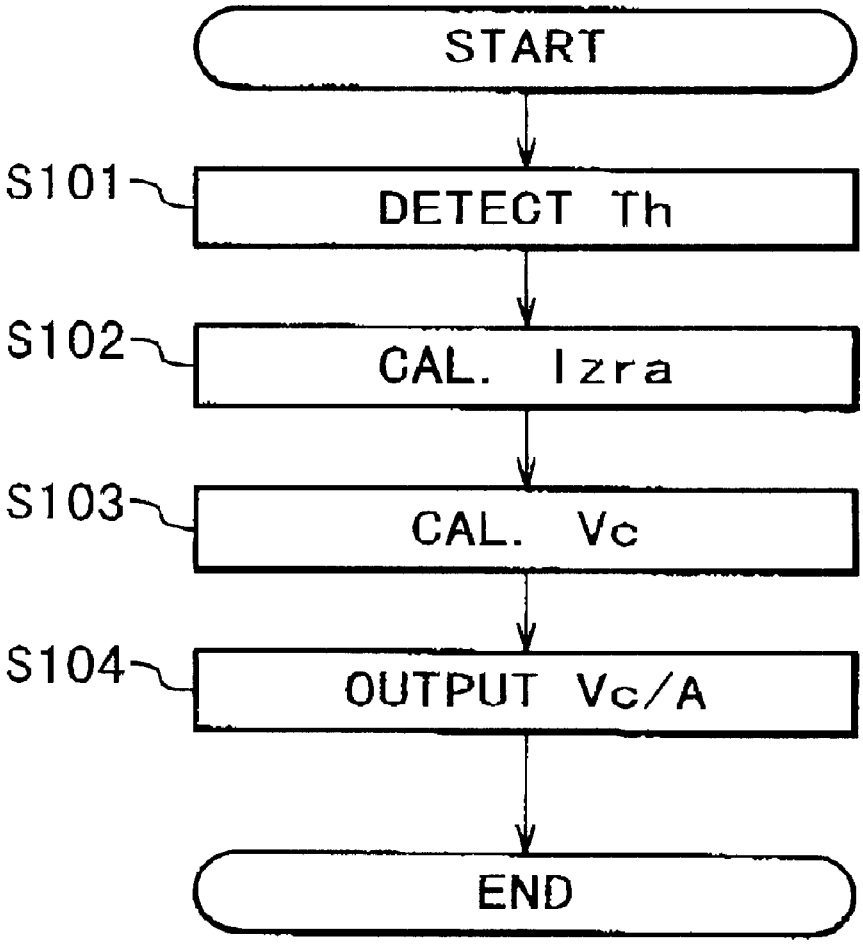
FIG. 31 is a flow chart of a control in Embodiment 6.

The description will be made, referring to a flow chart of FIG. 31. When the time Th in which the operational amplifier 1210 produced a Low output is detected at step S101, a resistance load current component Izra is calculated in the following manner:

$$Izra=2\times Tq\times Vs/R/\pi/Th\times\tan(\pi\times Th/2/Tq).$$

where

Tq: half cycle duration of the sine wave voltage

R: a resistance value between the charging roller and the photosensitive drum.

Then, the control value (voltage) of the averaging current is calculated by the calculation formula at step S103.

$$Vc=12V-r\times(Isa+Izra) \quad (2)$$

Isa: a target value of the average discharge current (50 $\mu$A in this embodiment).

R: a resistance value of the current and voltage conversion resistor 1219.

A voltage Vc/A (Vc is divided by an amplification A of the non-reversion amplifying circuit 1303–1305) is outputted from the D/A conversion port 5*f*.

As described in the foregoing, the system of this embodiment comprises a photosensitive drum 1 (member to be charged), a charging roller 2 (charge member) provided on the surface of the photosensitive drum, a high voltage source 12 for applying an AC voltage, particularly, a sine wave AC voltage to the charging roller 2, a voltage range detecting means 1201 for detecting a voltage range of the AC voltage applied to the charging roller 2, that is, the voltage range in which the absolute value of the AC voltage is not lower than the predetermined value, for example, the range in which the sine wave AC voltage is not lower than the than the predetermined positive voltage, average current detecting means for detecting an averaging current provided by the high voltage source in the predetermined voltage range of the AC voltage based on the output of the voltage range detecting means, and resistor current calculating means for calculating a resistance load current component of the averaging current detected by current detecting means from the output of the voltage range detecting means, wherein the control current is switched in accordance with the result of calculation of the resistor current calculating means. By this, the discharge current alone can be controlled with precision, and the increase of the discharge current due to the contamination of the charging roller can be prevented, and therefore, the scraping of the photosensitive drum can be suppressed, and the service life of the photosensitive drum can be remarkably extended.

In the foregoing the resistor current calculating means is constituted by the CPU5, and the means for switching the control current in accordance with the result of calculation oft resistor current calculating means is constituted by the CPU5, the DA output 5*f* thereof, the operational amplifier 1303 and the resistors 1304, 1305.

As described in the foregoing, according to this embodiment, the outputing current in the voltage phase range with the center thereof at the peak of the voltage amplitude is smoothed, and therefore, as shown in FIG. 26, the capacity load currents (Izc) occupying most of the outputing current are offset, so that discharge current can be detected with higher accuracy, and therefore, the control accuracy is higher.

As shown in FIG. 4, the characteristics, at the initial stage of use of the charging roller, of the average current and the discharge current in one or both the voltage range in which the sine wave AC voltage is not lower than the predetermined positive voltage and the voltage range in which it is not higher than the predetermined negative voltage, is substantially maintain even after substantial use thereof, or slightly changes such that inclination of the characteristics slightly decreases. Therefore, the increase of the discharge current attributable to the condemnation of the charging roller 2 or the like as in the conventional system FIG. 14, can be prevented even when the integrated number of output prints increases, and therefore, the scraping speed of the member to be charged (photosensitive drum 1) can be suppressed even when the integrated number of the output prints increases as shown in FIG. 5, and the service life of the member to be charged can be remarkably extended.

The charge member is not limited to the roller type, but may be of a blade type, brush type or the like.

The charge member is not necessarily contacted to the member to be charged, but may be out of contact therefrom (proximity) if a discharge region determination ed by a voltage across the gap and the correction Paschen curve, is assured between the charge member and the member to be charged. This invention covers such a structure.

The charging device of the present invention is effective to electrically charge (or discharging) an image bearing member such as a photosensitive member, a dielectric member for electrostatic recording or the like of an image forming apparatus or another member to be charged. While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a charge member for electrically charging said image bearing member while contacting to said image bearing member;

voltage applying means for applying an oscillating voltage including a component of AC voltage to said charge member;

first detecting means for detecting an average of the AC current applied to said charge member from said voltage applying means;

second detecting means for detection a value of the AC current corresponding to a peak of the AC voltage; and control means for effecting control such that when a detected current value of said first detecting means is smaller than a first predetermined value, the detected current value of said first detecting means is at the first predetermined value, and when the detected current value of said first detecting means is larger than the first predetermined value, a current value of said second detecting means is at a second predetermined value.

2. An image forming apparatus according to claim 1, wherein said first detecting means detects an average of a half wave current of the AC current.

3. An image forming apparatus according to claim 1, further comprising phase detecting means for detecting a phase of the AC voltage.

4. An image forming apparatus according to claim 3, wherein said first detecting means detects an average of the AC current in a predetermined phase range on the basis of an output of said phase detecting means.

5. An image forming apparatus according to claim 3, wherein said second detecting means detects a value of the AC current based on an output of said phase detecting means.

6. An image forming apparatus according to claim 1, wherein the AC voltage is a sine wave AC voltage.

7. An image forming apparatus according to claim 1, wherein said first detecting means and said second detecting means detect currents having different polarities, respectively.

8. An image forming apparatus according to claim 1, wherein said voltage applying means applies to said charge member a DC voltage superimposed with the AC voltage.

9. An image forming apparatus according to claim 1, further comprising a process cartridge detachably mountable to the main assembly of said image forming apparatus, said process cartridge containing said image bearing member and said charge member as a unit.

10. An image forming apparatus comprising:

an image bearing member;

a charge member for electrically charging said image bearing member while contacting said image bearing member;

voltage applying means for applying an oscillating voltage including a component of AC voltage to said charge member;

detecting means for detecting an average of an AC current supplied to said charge member from said voltage applying means in a voltage range within one cyclic period of the oscillating voltage which includes only one peak voltage and in which the oscillating voltage has a level exceeding a predetermined range; and control means for effecting control such that the average detected current value of said detecting means is at a predetermined value.

11. An image forming apparatus according to claim 10, wherein the voltage range includes the one peak of the AC voltage and a neighborhood thereof.

12. An image forming apparatus according to claim 10, further comprising resistance current detecting means for detecting a resistance load current component of an average detected current of said detecting means, wherein said control means switches the predetermined value in accordance with a detected value of said resistance current detecting means.

13. An image forming apparatus according to claim 10, wherein the AC voltage is a sine wave AC voltage.

14. An image forming apparatus according to claim 10, wherein said voltage applying means applies to said charge member a DC voltage superimposed with the AC voltage.

15. An image forming apparatus according to claim 10, further comprising a process cartridge detachably mountable to the main assembly of said image forming apparatus, said process cartridge containing said image bearing member and said charge member as a unit.

* * * * *

UNITED STATES PATENT AND TRADEMARK OFFICE

CERTIFICATE OF CORRECTION

PATENT NO. : 6,564,023 B2
DATED : May 13, 2003
INVENTOR(S) : Hiroshi Takami et al.

Figure 28:
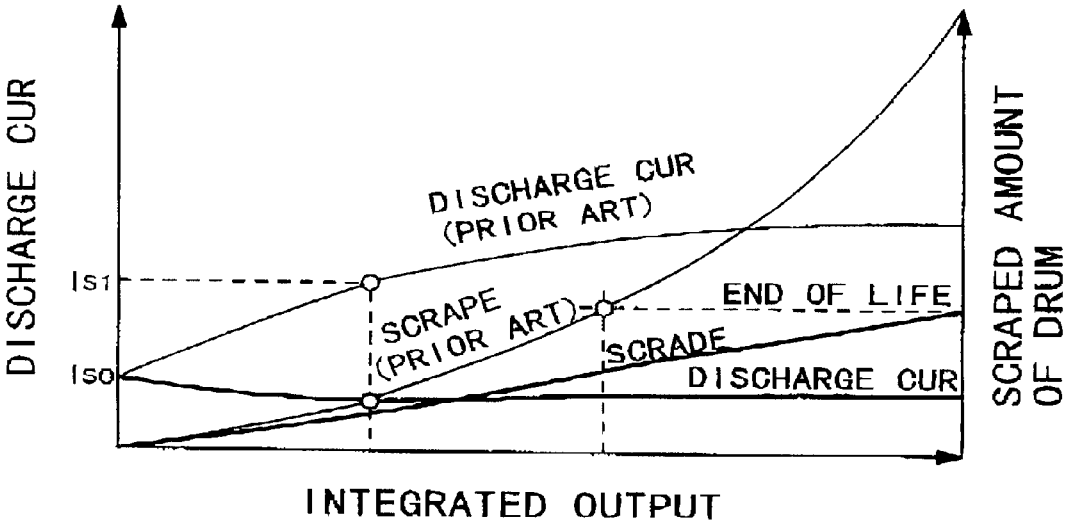
FIG. 28 is a graph of photosensitive drum scraping.

It is certified that error appears in the above-identified patent and that said Letters Patent is hereby corrected as shown below:

Drawings,
FIG. 17, “VLUE” should read -- VALUE --; and
FIG. 28, “SCRADE” should read -- SCRAPE --.

Column 1,
Line 33, “is” should read -- is, --.

Column 2,
Line 43, “resisters” should read -- resistors --.

Column 5,
Line 53, “RON 5*b*,” should read -- ROM 5*b*, --.

Column 6,
Line 35, “discharge” should read -- discharged --; and
Line 55, “material F” should read -- material P --.

Column 7,
Line 59, “halt” should read -- half --.

Column 8,
Line 34, “the -” should read -- the “-” --.

Column 9,
Line 47, “Be” should read -- 5e --.

Column 10,
Line 61, “out” should read -- out. --.

Column 11,
Line 42, “halt” should read -- half --.

Column 12,
Line 35, “other” should read -- order --.

UNITED STATES PATENT AND TRADEMARK OFFICE

CERTIFICATE OF CORRECTION

PATENT NO. : 6,564,023 B2
DATED : May 13, 2003
INVENTOR(S) : Hiroshi Takami et al.

It is certified that error appears in the above-identified patent and that said Letters Patent is hereby corrected as shown below:

Column 16,
Line 14, “a -” should read -- a “-” --; and
Line 32, “the than the” should read -- the --.

Column 17,
Line 57, “the than the” should read -- the --.

Column 18,
Line 10, “oft” should read -- of the --.

Signed and Sealed this

Twentieth Day of January, 2004

JON W. DUDAS
*Acting Director of the United States Patent and Trademark Office*